US007474867B2

(12) United States Patent
Ozeki et al.

(10) Patent No.: US 7,474,867 B2
(45) Date of Patent: Jan. 6, 2009

(54) MAGNETIC CARRIER, TWO-COMPONENT DEVELOPER, DEVELOPMENT METHOD, DEVELOPMENT DEVICE AND IMAGE FORMING APPARATUS OF ELECTROPHOTOGRAPHY

(75) Inventors: Takamasa Ozeki, Yokohama (JP); Takayuki Maruta, Yokohama (JP); Takuji Yoneda, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 11/209,770

(22) Filed: Aug. 24, 2005

(65) Prior Publication Data

US 2005/0281593 A1 Dec. 22, 2005

Related U.S. Application Data

(62) Division of application No. 10/746,060, filed on Dec. 29, 2003, now Pat. No. 7,020,421.

(30) Foreign Application Priority Data

Dec. 27, 2002 (JP) ..... 2002-380935
Feb. 27, 2003 (JP) ..... 2003-051489

(51) Int. Cl.
*G03G 15/09* (2006.01)

(52) U.S. Cl. ..... 399/270; 399/272; 399/267

(58) Field of Classification Search ..... 399/270, 399/272–276, 279, 267
See application file for complete search history.

(56) References Cited

U.S. PATENT DOCUMENTS 4,540,645 A 9/1985 Honda et al.
5,885,742 A 3/1999 Okado et al.
6,127,079 A * 10/2000 Sumiyoshi et al. ..... 430/111.35

FOREIGN PATENT DOCUMENTS

| | | |
|---|---|---|
| EP | 0 109 860 | 5/1984 |
| EP | 0 928 998 | 7/1999 |
| EP | 1 246 024 | 10/2002 |
| JP | 54-155048 | 12/1979 |
| JP | 57-040267 | 3/1982 |
| JP | 58-108548 | 6/1983 |
| JP | 58-108549 | 6/1983 |
| JP | 59-166968 | 9/1984 |

(Continued)

OTHER PUBLICATIONS

Patent Abstracts of Japan, JP 2001-242696, Sep. 7, 2001.

*Primary Examiner*—Hoang Ngo
(74) *Attorney, Agent, or Firm*—Oblon, Spivak, McClelland, Maier & Neustadt, P.C.

(57) ABSTRACT

A two-component developer including toner and magnetic carriers is provided. The two-component developer is characterized in that when a development device including a developer bearing member bearing the two-component developer is operated under a development condition of an image forming apparatus using a quasi-photoconductor in which a 10 μm thick layer of tetrafluoroethylene resin is provided to a conductive material, the number of times of light emission occurring in a magnetic brush formed on the developer bearing member due to partial conduction in the magnetic brush is 10 times or less per second at an observation cross section that is perpendicular relative to a rotation axis of the developer bearing member.

2 Claims, 13 Drawing Sheets

FOREIGN PATENT DOCUMENTS

| | | |
|---|---|---|
| JP | 64-019584 | 1/1989 |
| JP | 27-46885 | 3/1989 |
| JP | 26-83624 | 3/1990 |
| JP | 03-000628 | 1/1991 |
| JP | 29-95949 | 3/1993 |
| JP | 05/273789 | 10/1993 |
| JP | 06/202381 | 7/1994 |
| JP | 07-234548 | 9/1995 |
| JP | 08/006307 | 1/1996 |
| JP | 09/160304 | 6/1997 |
| JP | 10-055113 | 2/1998 |
| JP | 2001-027828 | 1/2001 |
| JP | 2001-188388 | 7/2001 |
| JP | 2001-324862 | 11/2001 |
| JP | 2002-207324 | 7/2002 |
| JP | 2002-229273 | 8/2002 |

* cited by examiner

MAGNETIC CARRIER, TWO-COMPONENT DEVELOPER, DEVELOPMENT METHOD, DEVELOPMENT DEVICE AND IMAGE FORMING APPARATUS OF ELECTROPHOTOGRAPHY

This application is based upon and claims the benefit of priority under 35 U.S.C. § 120 from U.S. Application Ser. No. 10/746,060, filed Dec. 29, 2003 now U.S. Pat. No. 7,020,421, and under 35 U.S.C. § 119 from Japanese Patent Applications No. 2002-380935 and No. 2003-051489 filed in the Japanese Patent Office on Dec. 27, 2002 and Feb. 27, 2003, respectively, and the entire contents of which are incorporated herein by reference.

BACKGROUND OF THE INVENTION

1. Field of the Invention

The present invention relates to a magnetic carrier, a two-component developer, a development method, a development device, and an image forming apparatus of electrophotography.

2. Discussion of the Background

In image forming apparatuses using electrophotography, such as copiers, facsimile machines, or printers, it is known to use a two-component development device having a two-component developer including magnetic carriers and toner or a single-component development device using only toner for development. Generally, a two-component development device includes a development sleeve serving as a developer bearing member. The development sleeve is cylindrical and is rotatably supported, and includes a magnetic roller inside thereof, the magnetic roller having a plurality of magnetic members with magnetic poles. A two-component developer including magnetic carriers to which toner has adhered is borne on a surface of the development sleeve to be conveyed to a development area formed between the developer bearing member and an image bearing member, wherein an electrostatic latent image borne on the image bearing member is developed with a magnetic brush formed by the two-component developer. In a two-component development device, magnetic carriers and toner are stirred and mixed, so that the charge property of the toner is relatively stable, and thereby a relatively stable and satisfactory image is obtained.

However, toner density in a two-component developer changes due to deterioration of magnetic carriers and consumption of toner in the developer, and the mixture ratio of the toner and the magnetic carriers of the developer changes. Therefore, generally, for suppressing a change in the mixture ratio of toner and magnetic carriers in a two-component developer, a toner density control device is provided, and new toner is replenished as necessary to suppress the change in the mixture ratio of the toner and the magnetic carriers.

In a single-component development device, toner borne on a surface of a developer bearing member is conveyed to a development area to develop a latent image borne on an image bearing member. Although certain drawbacks of a two-component development device, such as deterioration of magnetic carriers and necessity of providing a toner density control device do not exist in the single-component development device, the charge property of the toner is relatively unstable.

With respect to magnetic carriers used in such a two-component development device, it is generally desired that surfaces thereof are uniformly formed, and filming of toner on surfaces thereof, oxidization of surfaces thereof, and deterioration of the humidity sensing property are prevented. Further, a photoconductor serving as an image bearing member is desired to be protected from being scratched or worn by the carriers. Also, it is necessary to lengthen the life of a developer including the carriers, and to control a charge polarity of the developer or to adjust a charge quantity of the developer.

For those purposes, generally, a relatively firm and strong coating layer is provided to the carriers by coating the carriers with an appropriate resin material. For example, Japanese Patent Laid-open Publication No. 58-108548 describes a magnetic carrier coated with a resin material. Also, magnetic carriers including coating layers in which various types of additives have been added are described in Japanese Patent Laid-open Publications No. 54-155048, No. 57-40267, No. 58-108549, No. 59-166968, and No. 6-202381, and Japanese Patent Publications No. 1-19584 and No. 3-628, respectively. Further, Japanese Patent Laid-open Publication No. 5-273789 describes a magnetic carrier in which an additive adheres on the surface of the carrier. Also, Japanese Patent Laid-open Publication No. 9-160304 describes a magnetic carrier having a coating film in which conductive particles larger than the thickness of the coating film are contained. Japanese Patent Laid-open Publication No. 8-6307 describes a magnetic carrier in which benzoguanamine-n-butylalcohol-formaldehyde copolymer is used in major proportions for a carrier coating material, and Japanese Patent Publication No. 2683624 describes a magnetic carrier in which a cross-linking material of melanin resin and acrylic resin is used for a carrier coating material.

Also, for further enhancing durability of magnetic carriers, the present applicant proposes in Japanese Patent Laid-open Publication No. 2001-188388 an electrophotographic carrier having a coating film including at least a bonding resin and particles, in which a diameter D of the particles and a thickness h of a film of the bonding resin satisfies the relation: $(1<D/h<5)$. In the proposed carrier, the particles are relatively convex as compared with the coating film. Therefore, in stirring a developer including the carriers and toner so that the developer is charged by friction, contacting of the carriers with each other or with toner, a strong shock against the bonding resin due to friction between the carriers or with the toner is mitigated. Thereby, excessive adhesion of toner to the carriers can be prevented, and at the same time scraping of the coating film of the bonding resin, where charging occurs, can be prevented, so that a change in surface shapes of the carriers over time is relatively small and durability of the carriers is greatly enhanced.

In the above-described two-component development device, with a recent demand for enhancement of image quality, a size of toner particles tends to be decreased, and concurrently with this, magnetic carriers also tend to be made small in particle diameter. Particularly, by making magnetic carriers small in particle diameter, a magnetic brush formed on a developer bearing member at the position where the developer bearing member opposes a photoconductor can be made relatively fine, and thereby enhancement of gradation in a halftone image and uniformity in a solid image can be expected. Further, because the magnetic carriers are made relatively light at the same time, it is advantageous to prevent deterioration of a developer including the magnetic carriers.

However, as the particle diameter of a magnetic carrier is smaller, magnetization intensity of the magnetic carrier is smaller, so that adhesion of the carrier to a photoconductor easily occurs. Generally, a magnetic carrier is held on a developer bearing member by a magnetic force, and at the same time, an electric charge due to electrostatic induction or charge injection exists in the magnetic carrier, and an electrostatic force acts between an electric charge on the photoconductor and that of the magnetic carrier. The magnetic force acting on each particle of the magnetic carrier is smaller as the particle diameter of the magnetic carrier is smaller. Therefore, when a magnetic carrier is small in particle diameter such that an electrostatic force of a photoconductor is greater than a magnetic force of a developer bearing member holding the magnetic carrier, the magnetic carrier easily adheres onto the photoconductor. Further, with a recent demand for miniaturization of an apparatus, the diameter of a photoconductor drum serving as an image bearing member and the diameter of a development sleeve serving as a developer bearing member tend to be decreased. With such miniaturization of the diameters of the photoconductor drum and the development sleeve, the magnetic holding force of a magnetic brush relative to carriers borne on ears of the magnetic brush at a downstream region of a development area formed between the photoconductor drum and the development sleeve (at the exit side of the development area) is decreased, so that adhesion of the carriers to the photoconductor drum as the image bearing member more easily occurs. With such occurrence of adhesion of the carriers to the photoconductor drum, deterioration of the photoconductor drum as the image bearing member, a cleaning blade for the photoconductor drum, and an intermediary transfer member is accelerated, and white spots in an image area and/or background soiling due to adhesion of the carriers to the photoconductor drum are generated in an image at the same time.

For preventing such adhesion of a magnetic carrier to a photoconductor, it is conceivable to increase magnetization of the magnetic carrier to increase a magnetic force of the magnetic carrier. In a ferrite carrier, however, the ratio of an iron component must be increased to increase a magnetic force of the carrier, so that the electric resistance value of a developer including the carrier is decreased. With respect to electrical resistance of developers and magnetic carriers, various studies have been made in the past. Japanese Patent Publication No. 2746885 specifies a range of dynamic resistance values of magnetic carriers when the magnetic carriers are conveyed by a developer bearing member. Japanese Patent Publication No. 2995949 specifies a range of volume resistance values of a developer including toner and magnetic carriers in a magnetic brush form in an electric field of 1000V/cm. By specifying lower limits of dynamic electric resistance values of a magnetic carrier and volume resistance values of a developer, charge injection from a developer bearing member to the magnetic carrier or charge injection from the developer to a photoconductor is prevented, and thereby adhesion of the carrier to the photoconductor, fogging in a background of an image, etc. are prevented. However, the above-described JP publications do not touch on address electrical resistance of magnetic carriers small in particle diameter.

As a method of remedying adhesion of a magnetic carrier to a photoconductor, it is conceivable to increase saturation magnetization of the magnetic carrier to a certain extent. By increasing saturation magnetization of a magnetic carrier, even when the particle diameter of the carrier is relatively small, the magnetic holding force of a magnetic brush relative to the carrier borne on an ear of the magnetic brush can be maintained to a certain extent. Saturation magnetization of a carrier has a certain relation with resistance of the carrier. When saturation magnetization of a carrier is increased, resistance of the carrier decreases, and on the contrary when saturation magnetization of a carrier is decreased, resistance of the carrier increases. However, it does not mean that a strict relation exists between saturation magnetization of a carrier and resistance of the carrier. Here, resistance of a magnetic carrier is so-called static resistance, which is a resistance value of the magnetic carrier measured a certain fixed time after a predetermined bias has been applied after having been put into parallel electrodes for resistance measurement and converted to volume resistivity.

If resistance of carriers is decreased, counter-charge remaining in the carriers after developing a solid image area easily deteriorates, so that adhesion of the carriers to an edge part of the solid image area, which is caused by the counter-charge, decreases. FIG. 1 is a schematic diagram illustrating states of an electric field of an image area and that of a non-image area. In the image area, an electric field, in which toner moves from a development sleeve toward the photoconductor drum side, is formed. In the non-image area, the electric field, in which toner moves toward the photoconductor drum side, does not exist. In an edge area E, which is a boundary between the image area and the non-image area, an edge electric field in which carriers move toward the photoconductor drum to adhere to the photoconductor drum, is formed. Intensity of the edge electric field is stronger as resistance of the carriers is higher, and is weaker as the resistance of the carriers is lower.

When resistance of carriers is relatively low, the above-described adhesion of the carriers to a photoconductor drum is decreased, but on the other hand an electric charge of the carriers easily leaks. In addition, when a superimposed bias in which an AC bias has been superimposed on a DC bias is applied between the photoconductor drum and a development sleeve bearing a developer including the carriers, because a relatively high voltage is instantaneously applied by the AC bias, the electric charge of the carriers leaks more easily.

If such conditions are combined, a leak occurs between the photoconductor drum and the development sleeve via the carriers, and thereby a latent image on the photoconductor drum is disturbed. As a result, density unevenness of a spotted pattern sometimes occurs in a halftone part of an image. A halftone image with density unevenness of a spotted pattern is herein referred to as a "spotted halftone image."

Generally, electric resistance of a magnetic carrier is adjusted with resistance of resin for coating ferrite as a core member of the magnetic carrier. Experiments have been performed by inventors of the present application using a two-component developer including a magnetic carrier while adjusting electrical resistance of the magnetic carrier such that the dynamic electrical resistance value of the carrier and the volume resistance value of the developer are within the ranges specified in the above-described JP publications, respectively. However, a satisfactory result has not been obtained with respect to occurrence of the above-described spotted halftone image, and it has been found that a more detailed study on development characteristics of the developer in a development process is necessary.

Japanese Patent Laid-open Publication No. 10-55113 specifies a range of dynamic resistance values of a magnetic carrier in a magnetic brush form in an electric field of 104V/cm, which is close to a development electric field of an actual production apparatus. The JP publication describes that by setting the dynamic resistance value of a magnetic carrier within the specified range, adhesion of the carrier to a photoconductor, and an inferior image, such as the one an image having a brush mark resulting from breakdown of a latent image on the photoconductor due to bias leaking, can be suppressed, so that a halftone part of an image can be reproduced in high quality. However, the JP publication does not give any hint as to eliminating occurrence of a spotted halftone image.

Such a spotted halftone image may be avoided by setting resistance of magnetic carriers high to a certain extent. However, it has been found that sometimes an adverse effect occurs if resistance of magnetic carriers is increased such that generation of a spotted halftone image and adhesion of the carriers to a photoconductor drum can both be avoided. Specifically, an inferior image called a hollow image occurs, in which the periphery of a solid part or a character written in a halftone part thereof is dropped in white due to increase of the edge effect.

In a two-component development device, by using a magnetic brush to resemble an adjacent opposing electrode, a so-called returning electric field can be suppressed, so that it is possible to decrease the edge effect. Further, as a method of generating a state of an electric field similar to the one generated by bringing an opposing electrode closer, such methods are available as decreasing resistance of a magnetic carrier and decreasing a development gap. Accordingly, increasing resistance of a magnetic carrier as described above brings a state of an electric field similar to the one generated when an opposing electrode is separated in the distance, so that the edge effect is increased, and thereby a hollow image easily occurs.

As described above, it has been found that when taking measures to avoid adhesion of a magnetic carrier to a photoconductor that is caused by decreasing a particle diameter of the magnetic carrier, adverse effects are caused, such as occurrence of a spotted halftone image (a halftone image with density unevenness of a spotted pattern) and occurrence of a hollow image (an image in which the periphery of a solid part or a character written in a halftone part thereof is dropped in white). Thus, it is desired that adhesion of magnetic carriers to a photoconductor is suppressed and at the same time the above-described adverse effects are suppressed to a certain extent.

SUMMARY OF THE INVENTION

The present invention has been made in view of the above-discussed and other problems and addresses the above-discussed and other problems.

Preferred embodiments of the present invention provide a novel magnetic carrier and a novel two-component developer including the magnetic carrier suitable for obtaining a high quality and fine image that improves a spotted halftone image (a halftone image with density unevenness of a spotted pattern) and suppresses occurrence of a hollow image (an image in which the periphery of a solid part or a character written in a halftone part thereof is dropped in white).

The preferred embodiments of the present invention further provide a novel development method, a novel development device, and a novel image forming apparatus that use the two-component developer to obtain a high quality and fine image.

The preferred embodiments of the present invention further provide a novel image forming apparatus including a two-component development device using a magnetic carrier relatively small in particle diameter that can realize suppression of adhesion of the magnetic carrier to a photoconductor while suppressing a spotted halftone image and a hollow image within allowable ranges.

According to a preferred embodiment of the present invention, a two-component developer including toner and magnetic carriers is provided. The two-component developer is characterized in that when a development device including a developer bearing member bearing the two-component developer is operated under a development condition of an image forming apparatus using a quasi-photoconductor in which a layer of tetrafluoroethylene resin is provided to a conductive material in 10 μm thick, the number of times of light emission occurring in a magnetic brush formed on the developer bearing member due to partial conduction in the magnetic brush is 10 times or less per second at an observation cross section that is perpendicular relative to a rotation axis of the developer bearing member.

According to another preferred embodiment of the present invention, another two-component developer including toner and magnetic carriers is provided. The another two-component developer is characterized in that in a development device including a developer bearing member having a magnetic field generation device inside thereof and bearing the two-component developer thereupon and a developer regulation member regulating a thickness of a layer of the two-component developer borne on the developer bearing member and in which a distance between the developer bearing member and the developer regulation member is about 0.7 mm and a distance between the developer bearing member and a quasi-photoconductor in which a layer of tetrafluoroethylene resin is provided to a conductive material in 10 μm thick is about 0.35 mm, when a magnetic brush formed on the developer bearing member is caused to rub a surface of the quasi-photoconductor by rotating the quasi-photoconductor at a linear velocity of 245 mm/sec and the development sleeve at a linear velocity of 515 mm/sec, and a DC voltage of 450V superimposed with an AC voltage of 9 kHz in frequency and 900V in Vpp is applied between the developer bearing member and the quasi-photoconductor, the number of times of light emission occurring in the magnetic brush formed on the developer bearing member due to partial conduction in the magnetic brush is 10 times or less per second at an observation cross section that is perpendicular relative to a rotation axis of the developer bearing member.

According to another preferred embodiment of the present invention, a magnetic carrier for use in the above-described two-component developers is provided.

According to still another preferred embodiment of the present invention, a development method of developing an electrostatic latent image on a surface of an image bearing member using either of the above-described two-component developers is provided. The method includes the steps of: bearing a two-component developer including toner and magnetic carriers on a developer bearing member arranged to oppose the image bearing member and including a magnetic field generation device inside thereof; conveying the two-component developer borne on the developer bearing member to a development area formed between the developer bearing member and the image bearing member; and causing a magnetic brush formed on the developer bearing member to rub the surface of the image bearing member to develop the electrostatic latent image on the surface of the image bearing member.

According to still another preferred embodiment of the present invention, a development device developing an electrostatic latent image on an image bearing member using either of the above-described two-component developers is provided. The development device includes a developer bearing member arranged to oppose the image bearing member and including a magnetic field generation device inside thereof, and a rotation drive device to rotate the developer bearing member. The developer bearing member bears the two-component developer including toner and magnetic carriers to convey the two-component developer to a development area formed between the developer bearing member and the image bearing member, and a magnetic brush formed on the developer bearing member is caused to rub a surface of the image bearing member, thereby developing the electrostatic latent image on the image bearing member.

According to still another preferred embodiment of the present invention, an image forming apparatus including the above-described development device is provided.

According to still another preferred embodiment of the present invention, an image forming apparatus includes an image bearing member bearing an electrostatic latent image on a surface thereof, a developer bearing member including a non-magnetic development sleeve, the development sleeve including a fixed magnetic field generation device inside thereof and rotating while bearing on a surface thereof a two-component developer including a magnetic carrier and toner, and a development electric field generation device configured to generate a development electric field between the image bearing member and the developer bearing member. The electrostatic latent image on the image bearing member is visualized into a toner image with the toner of the two-component developer borne on the developer bearing member by a function of the development electric field generated by the development electric field generation device. An average particle diameter by weight of the magnetic carrier is 20 μm or greater but not exceeding 60 μm, a saturation magnetization of the magnetic carrier in a magnetic field of 1 kOe is 66 emu/g or greater but not exceeding 100 emu/g, a static resistance of the magnetic carrier when a bias of 1000V is applied to the magnetic carrier is $10^9$ Ωcm or greater but not exceeding $10^{14}$ Ωcm, and only a DC bias is applied to generate the development electric field by the development electric field generation device.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
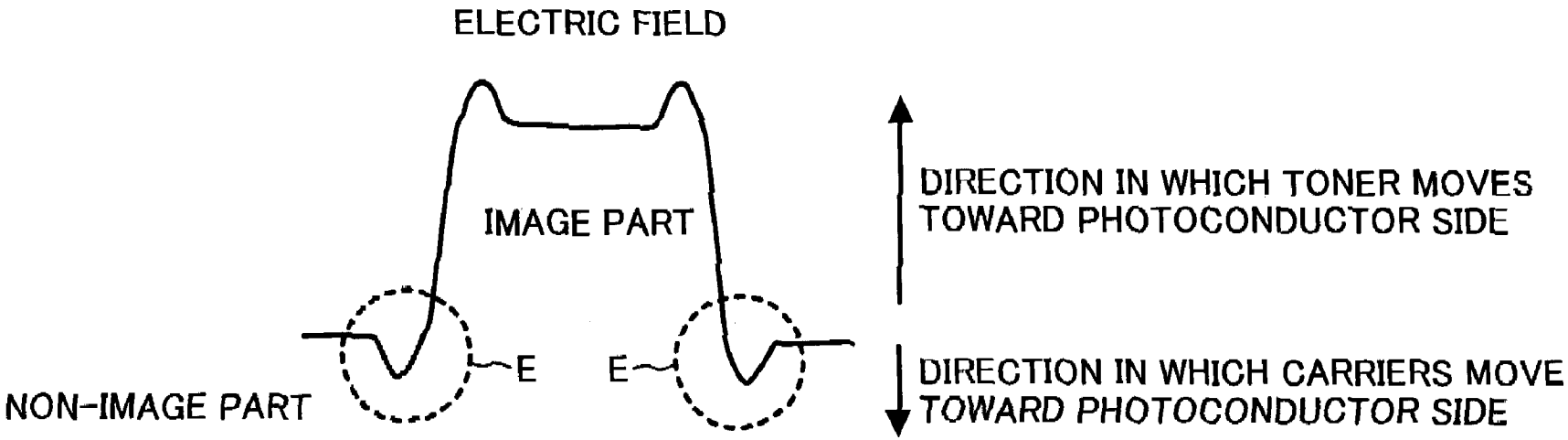
FIG. 1 is a schematic diagram illustrating states of an electric field of an image area and that of a non-image area.

Referring now to the drawings, wherein like reference numerals designate identical or corresponding parts throughout the several views, preferred embodiments of the present invention are described.

Figure 2:
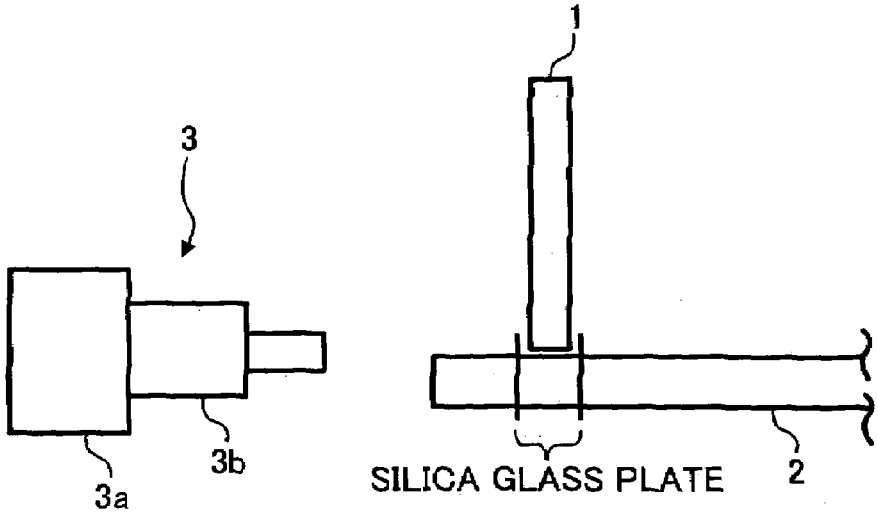
FIG. 2 is a diagram illustrating a construction of an apparatus used for analyzing behavior of a two-component developer according to an embodiment of the present invention in a development area of an image forming apparatus.

FIG. 2 is a diagram illustrating a construction of an apparatus used for analyzing behavior of a two-component developer according to an embodiment of the present invention in a development area of an image forming apparatus. A quasi-photoconductor 1 serving as an image bearing member is formed in a disk 90 mm in diameter and 10 mm in thickness. A photoconductive material, in this example, non-magnetic SUS, is used for a base substance of the disk, and tetrafluoroethylene resin (Teflon: registered trademark) is coated 10 μm thick on the circumference of the disk. A development sleeve 2 as a developer bearing member is arranged to oppose the quasi-photoconductor 1. The development sleeve 2 is a development sleeve having a magnetic field generation device inside thereof, which is generally used in a two-component development device. More specifically, a plurality of magnets, i.e., a primary development magnet for forming a magnetic brush of a two-component developer (sometimes referred to simply as a developer), a scoop magnet for scooping up the developer onto the development sleeve 2, a convey magnet for conveying the developer on the development sleeve 2 to a development area, another convey magnet for conveying the developer having been used for development, are arranged inside of the development sleeve 2 substantially at a center of the position where the quasi-photoconductor 1 and the development sleeve 2 oppose each other. Two pieces of silica glass plates, in which holes slightly larger than the diameter of the development sleeve 2 are formed, are arranged to sandwich the disk (quasi-photoconductor 1), the developer sleeve 2 being inserted through the holes of the plates, so that magnetic carrier particles will not slip out toward the development sleeve 2. The developer (in a predetermined quantity) is put in a space formed by the two silica glass plates. A doctor blade (not shown) as a developer regulation member regulating a quantity of the developer being conveyed by the development sleeve 2 is also arranged at a predetermined position while being sandwiched by the two silica glass plates.

Development conditions were set close to those of an actual image forming apparatus as follows, and behavior of the two-component developer was observed.

The distance between the development sleeve 2 and the doctor blade as a developer regulation member regulating a quantity of the developer being conveyed by the development sleeve 2 was 0.7 mm, and the distance between the quasi-photoconductor 1 and the development sleeve 2 was 0.35 mm. The quasi-photoconductor 1 and the development sleeve 2 were rotated in the same direction at the position where the quasi-photoconductor 1 and the development sleeve 2 opposed each other, the linear velocity of the quasi-photoconductor 1 was 245 mm/sec, and the velocity of the development sleeve 2 was 515 mm/sec.

A bias in which a DC of 450V and an AC of 9 kHz in frequency and 900V in Vpp (peak-to-peak voltage) have been superimposed were applied between the developer sleeve 2 and the quasi-photoconductor 1, the quasi-photoconductor 1 and the development sleeve 2 were rotated at the above-described velocities, and behavior of the developer in the development area at an observation cross section perpendicular to a rotation axis of the development sleeve 2 was photographed by a camera 3 with a central focus on a development nip. For the camera 3, a stereomicroscope 3*b* (SZH10 manufactured by Olympus Corporation) connected with a high-speed camera 3*a* (FASTCAM-Ultima-I2 with image intensifier manufactured by Photron, Ltd.) was used, and the photographing speed was 9000–40,500 frames/sec.

For a magnetic carrier of the developer, various types of magnetic carriers different from each other in weight average particle diameter, magnetization intensity, and electrical resistance were used. For toner, polymer toner 5 μm in volume average particle diameter was used. Toner density was varied to include 0 wt % (i.e., the case in which no toner was included).

With rotation of the development sleeve 2, the development sleeve 2 scoops up the developer by the scoop magnet, conveys the scooped-up developer to the development area where the development sleeve 2 and the quasi-photoconductor 1 oppose each other. When the developer borne on the development sleeve 2 reaches a vicinity of the primary development magnet, magnetic carriers of the developer gather to form ears of a magnetic brush to rise. Height of the ears of the magnetic brush is determined based on powder characteristic characteristics of the carriers such as weight average particle diameter, etc., magnetic characteristics of the carriers such as magnetization intensity, magnetic characteristics of the primary development magnet, such as magnetic flux density, etc., and shape characteristics of the primary development magnet such as width and shape. In experiments, the development conditions were set such that ears of the magnetic brush were tall enough to sufficiently rub the surface of the quasi-photoconductor 1. A state that ears of a magnetic brush move at substantially the same speed as the linear velocity of the development sleeve 2 while rubbing the surface of the quasi-photoconductor 1 was photographed by the camera 3.

Figure 3A:
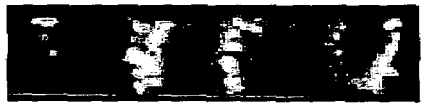
FIG. 3A is an example of an image of a magnetic brush emitting light, which has been photographed by a high-speed camera.

Behaviors of various developers in the development area were observed as described above, and with respect to some of the developers, light emission was observed in magnetic brushes. FIG. 3A is an example of an image of a magnetic brush emitting light, which was photographed by the high-speed camera 3*a*. Through a series of observations, a state that a piece of a magnetic carrier on the development sleeve 2 emits light and the light gradually extends toward the side of the quasi-photoconductor 1 transmitting through a magnetic brush and a state that one piece of an ear of a magnetic brush continues to emit light have been confirmed.

Figure 3B:
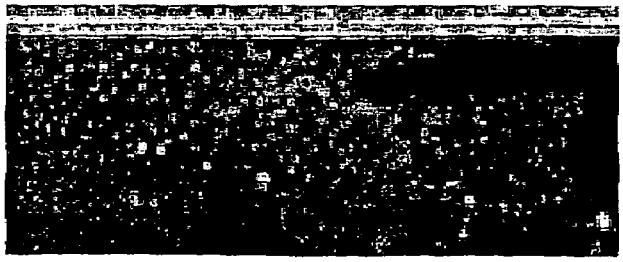
FIG. 3B is an example of an image of a magnetic brush turning to red, which has been photographed by a CCD camera.

For analyzing what causes such a light emission phenomenon, behavior of a developer has been photographed using a CCD camera (color video camera DXC-108 manufactured by Sony Corporation) instead of the high-speed camera 3*a*. FIG. 3B is an example of an image of a magnetic brush turning to red, which has been photographed by the CCD camera. Based upon such an observed state that ears of a magnetic brush turn to red as in FIG. 3B, it has been made clear that light emission of the magnetic brush is caused by heat which has been generated. As a result, an electric current flows transmitting through a certain ear of the magnetic brush from the development sleeve 2 to the quasi-photoconductor 1. That is, although it has been conventionally conceived that a magnetic brush is macroscopically homogeneous, it has been made clear that some ears of the magnetic brush are different from others in electric characteristics, in that resistance thereof is so low to cause the development sleeve 2 and the quasi-photoconductor 1 to be in the conductive state.

The frequency of such light emission in a magnetic brush as indicated in FIG. 3A changes depending on the type of carriers used in a developer. This is because that the quantity of carriers whose resistance is low to cause the development sleeve 2 and the quasi-photoconductor 1 to be in the conductive state, that exists in a magnetic brush, changes depending upon the type of the carriers. Further, even when carriers of the same type are used in a developer, the frequency of such light emission in a magnetic brush as indicated in FIG. 3A changes depending on the density of toner in the developer. This is because the toner closes a conduction circuit.

On the other hand, quality of halftone images has been evaluated with respect to the various types of developers described above. As a result, it has been found that when a developer causing such a spotted halftone image with density unevenness of a spotted pattern is used, a great deal of light emission is observed in a magnetic brush by the camera 3. By contrast, light emission is hardly observed in a magnetic brush when a developer reproducing a satisfactory halftone image without causing density unevenness of a spotted pattern is used. That is, it has been made clear that an ear of a magnetic brush that is relatively low in electrical resistance and that emits light by causing the development sleeve 2 and the quasi-photoconductor 1 to be conductive has an adverse effect on reproducibility of a halftone image.

Formation of a halftone image was performed using a popular image forming apparatus equipped with a two-component development device, under development conditions described below. The linear velocity of an OPC photoconductor was 245 mm/sec, the linear velocity of a development sleeve is 515 mm/sec, the distance between the OPC photoconductor and the development sleeve, i.e., the development gap, was 0.35 mm, and the width of a development nip was 3 mm. The DC voltage and the surface potential of the OPC photoconductor were adjusted so that image density of the halftone image was about 0.8. The superimposed AC voltage was constant at 9 kHz in frequency and 900V in Vpp.

Considering that an electrostatic latent image written digitally is becoming close to the one written with an analog method with the recent increase of resolution in digital images, formation of an electrostatic latent image of a halftone image was performed using a method of shifting the function of preventing toner adhesion with a development bias toward the development side by slightly decreasing a charge potential of the OPC photoconductor. Thereby, evaluation of halftone images was performed at an image quality level equivalent to a case wherein writing of latent images is performed with an analog method and smoother halftone image reproducibility is demanded.

Halftone images thus formed were evaluated by visual observation with respect to frequency of occurrence of density unevenness of a spotted pattern. Satisfactory halftone images having no density unevenness of a spotted pattern are rated at 5.0, and according to the degree of density unevenness of a spotted pattern, the halftone images were rated in increments of 0.5. Those halftone images rated at 3.0 or above are satisfactory images from a practical standpoint.

According to a detailed analysis of a result of the above-described evaluation, when a developer of the present invention that does not cause light emission in a magnetic brush in a development area at a frequency of 10 times or more in a second is used, density unevenness of a spotted pattern is not caused in a halftone image, i.e., a satisfactory halftone image is produced, and when a developer that causes light emission in a magnetic brush in the development area at a frequency exceeding 10 times in a second is used, a halftone image rated at 3.0 or less, which is unsatisfactory from a practical standpoint, is produced.

High frequency of light emission in a magnetic brush indicates, when viewed from the microscopic viewpoint, that many ears that easily pass an electric current easily exist in the magnetic brush. It can be said that an ear that easily passes an electric current includes magnetic carriers low in resistance, or includes exposed magnetic carriers because sufficient toner has not adhered to the magnetic carriers, so that the magnetic carriers are exposed. If such a magnetic brush rubs a surface of a photoconductor in an actual apparatus, charge injection to the surface of the photoconductor is actively performed, thereby leading to disturbing a latent image on the photoconductor, or because a static charge on the photoconductor is lost through the magnetic carriers low in resistance, in reversal development extra toner adheres to the photoconductor.

It has not been confirmed yet if light emission occurs in a magnetic brush of an actual apparatus, however, it is presumed that occurrence of such light emission is very rare. That is, a photoconductor drum used in an actual apparatus is constructed such that a UL layer (undercoat layer), a CGL layer (charge generation layer), and a CTL layer (charge transfer layer) are coated in that order on a base substance of aluminum, and electric resistance of the photoconductor drum is almost determined by the CTL layer. The thickness of the CTL layer is about 30 μm, and the dielectric constant thereof is about 3. Accordingly, the dielectric thickness of the CTL layer is 10 μm. On the other hand, the thickness of Teflon used for the coating layer of the quasi-photoconductor 1 is 10 μm and the dielectric constant thereof is 5, and accordingly the dielectric thickness of the quasi-photoconductor is 2 μm. From this, the resistance value of the quasi-photoconductor 1 is lower than that of a photoconductor drum used in an actual apparatus by 5 times or more. That is, it is presumed that when the quasi-photoconductor 1 is used, because of such difference in the resistance value from a photoconductor drum of an actual apparatus, differences in dielectric breakdown voltage and tunnel current in the coating layer are caused. Thereby light emission in a magnetic brush is caused, and that if the resistance value of the quasi-photoconductor 1 is increased to a level of a resistance layer (CTL layer) of a photoconductor used in an actual apparatus, light emission in a magnetic brush will not occur.

In any case, coexistence of an ear in a state that an electric current easily flows and an ear in a state that an electric current does not easily flow greatly influences uniformity of an electrostatic latent image of a halftone image, leading to generating density unevenness of a spotted pattern in the halftone image.

Now, description is made with respect to preferable electric characteristics of a two-component developer of the present invention. The dynamic resistance value of the two-component developer of the present invention in electric field intensity of 10 kV/cm is between $1.0\times10^{10}$ Ωcm and $5.0\times10^{12}$ Ωcm. Further, the two-component developer has a characteristic that in an electric field of 27 kV/cm or smaller, a dielectric breakdown is not caused to occur.

Measurement of a dynamic resistance value of the two-component developer was performed using a quasi-photoconductor of aluminum. A popular development sleeve having a magnetic generation device inside thereof was arranged to oppose a two-component development device, the development sleeve bearing the developer was rotated at the liner velocity of 515 mm/sec, a DC voltage was applied between the quasi-photoconductor in a stopped condition and the development sleeve, and the dynamic resistance value of the developer was measured from an applied voltage and an electric current flowed at that time. The development gap between the development sleeve and the quasi-photoconductor was 0.35 mm, and the width of a development nip was 3 mm.

The electric field intensity of 10 kV/cm was close to that of a development electric field of an actual apparatus, and it is necessary for a developer at the least to have dynamic resistance of $10\times10^{10}$ Ωcm or greater in this electric field to prevent leaking of charge and to bring out a development capability. When the dynamic resistance is smaller than this value, intensive carrier adhesion to a photoconductor occurs to cause a trouble to damage which damages the photoconductor.

Further, the developer should not cause dielectric breakdown in an electric field of 27 kV/cm or smaller. Here, dielectric breakdown is a phenomenon that in a substance under measurement put in a dynamic resistance value measurement system, i.e., in a relation between a voltage and a current applied to a developer in a magnetic brush state, a change in a current value with an increase of a measured voltage indicates $1.0\times10^{-6}$ A/V or greater. In other words, the actual resistance value of the substance put in the dynamic resistance value measurement system is $1.0\times10^{+6}$ A/V or smaller.

While measuring dynamic resistance values of various types of developers, quality of images formed with these developers have been evaluated with respect to halftone parts thereof, and it has been found that a satisfactory image having no density unevenness of a spotted pattern in a halftone part thereof is obtained with a developer that does not cause dielectric breakdown even when a high voltage is applied. In particular, when a developer does not cause dielectric breakdown unless a voltage of 950V or greater is applied, a satisfactory image rated at 3.0 or above with respect to a spotted halftone image can be obtained. At this time, because the electric field intensity applied to a magnetic brush is 27 kV/cm, the developer should not cause electric breakdown in electric field intensity smaller than 27 kV/cm. Further, when a carrier of the developer does not cause dielectric breakdown in electric field intensity of 40 kV/cm or smaller, a high quality image can be obtained.

The above-described electric characteristics of a developer are greatly related to frequency of a light emission phenomenon in a magnetic brush. That is, if a developer does not cause dielectric breakdown even when a development bias is applied between a development sleeve and a photoconductor so that electric field intensity applied to ears of a magnetic brush increases, charge injection to the photoconductor can be prevented, so that occurrence of light emission in the magnetic brush can be suppressed.

The upper limit of the dynamic resistance value of a developer in an electric field intensity of 10 kV/cm is preferably $5.0\times10^{12}$ Ωcm.

As described above, it was found that when a developer of high resistance in which high resistance resin was used for coating magnetic carriers is used for development for improving density unevenness of a spotted pattern in a halftone image, an irregular image called a hollow image newly occurs, in which the periphery of a solid part or a character written in a halftone part thereof is dropped in white.

Figure 4:
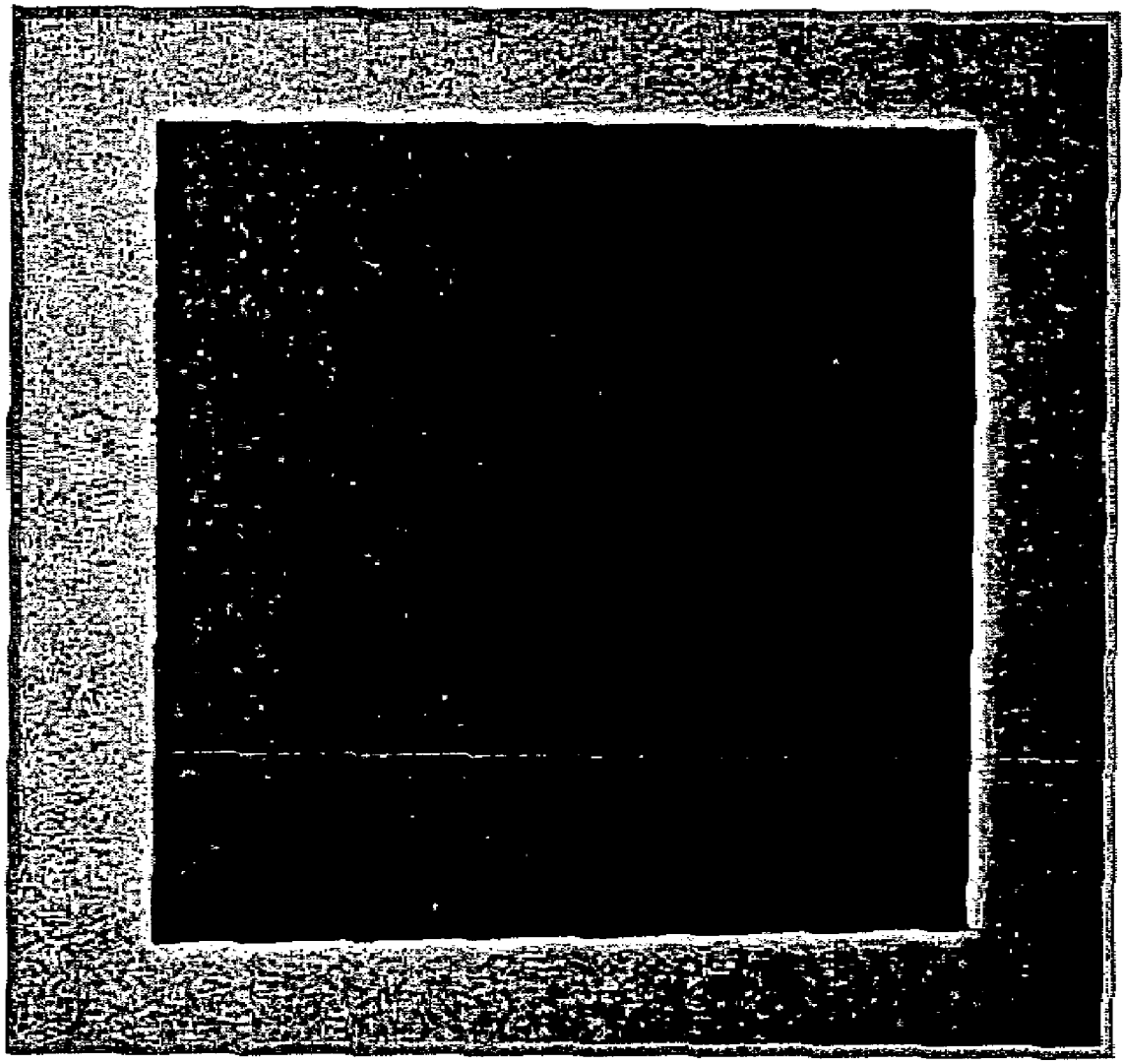
FIG. 4 is an exemplary hollow image.
Figure 5:
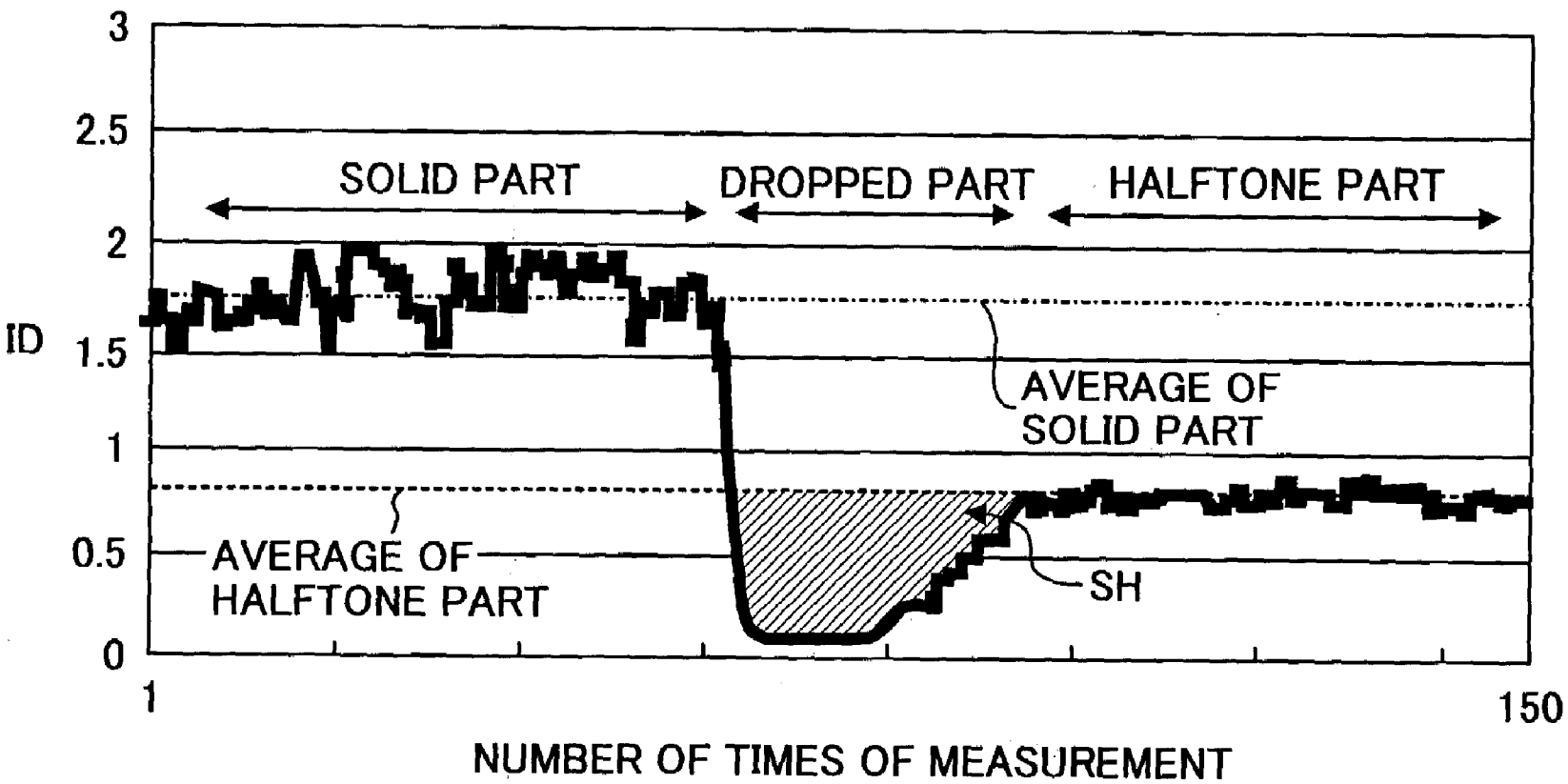
FIG. 5 is a diagram for explaining a method of evaluating a hollow image.

FIG. 4 is an exemplary hollow image. FIG. 5 is a diagram for explaining a method of evaluating a hollow image. A graph illustrated in FIG. 5 has been obtained by measuring image density of a part of an edge of a solid part of the exemplary hollow image of FIG. 4, 7 mm in length including a dropped part thereof, at 150 points at the intervals of about 50 μm, using a micro-photometer (MPM-2 manufactured by UNION OPTICAL Corporation). The shaded part in FIG. 5 corresponds to a part dropped in white in FIG. 4. The area of the shaded part of FIG. 5 is converted to a numerical value as an apparent dropping quantity SH. When obtaining the exemplary image of FIG. 4, for making evaluation conditions constant, the DC bias voltage and the surface potential of a photoconductor have been adjusted so that densities of the solid part and the halftone part are 1.7 and 0.8, respectively. The value of the apparent dropping quantity SH is ideally 0, however, 10 or smaller is preferable. When the value of the apparent dropping quantity SH is 5 or smaller, an almost ideal image can be obtained.

The relation between the dynamic resistance value of a developer and the above-described value of the apparent dropping quantity SH of a resulting hollow image has been examined with respect to the various types of developers of the present invention, and it has been found that as the dynamic resistance value of a developer in electric field intensity of 10 kVcm is greater, the value of the apparent dropping quantity SH of a resulting hollow image is greater. In order to make the value of the apparent dropping quantity SH 10 or smaller, the dynamic resistance value of a developer in electric field intensity of 10 kV/cm must be $5.0\times10^{12}$ Ωcm or smaller.

Thus, because of the above-described characteristics of the developers of the present invention, density unevenness of a spotted pattern is not generated in a halftone part of an image, so that the halftone part is reproduced in high quality and at the same time occurrence of a hollow image of a solid part or a character in the halftone part of the image is suppressed, and thereby a high quality image can be obtained.

Now description is made with respect to magnetic carriers of the present invention. For core members of the magnetic carriers, copper zinc ferrite, and such ferrite, principal component of which is manganese, e.g., manganese ferrite, manganese magnesium ferrite, etc., may be used. By adding a resistance adjustment agent such as bismuth (Bi) and zircon (Zr) or by appropriately adjusting conditions in a baking process or a subsequent process, such as temperature, time, and atmosphere, a core member high in magnetization and in resistance can be obtained. Further, particles of such a core member high in magnetization may be coated by acrylic, polyester, silicone or fluoric resin. Appropriate resin can be selected considering electric resistance and charge characteristic relative to toner of a magnetic carrier. For adjusting the characteristics of a magnetic carrier, conductive substance such as carbon black, aluminum oxide, and titanium oxide, or charge control agent may be added to the resin. Further, particles of magnetic substance may be dispersed in the above-described resin for coating.

Weight-average particle diameter of a magnetic carrier is preferably small (i.e., between 251 μm and 45 μm). By making weight-average particle diameter of a magnetic carrier 45 μm or smaller, a magnetic brush can be fine, so that gradation and uniformity in a solid area can be enhanced. When the weight-average diameter of a magnetic carrier is smaller than 25 μm, adhesion of the carrier to a photoconductor is caused, which is not desirable.

Magnetization intensity of a magnetic carrier in a magnetic field of 1 kOe is preferably between 60 emu/g and 80 emu/g. In particular, when a particle diameter of the magnetic carrier is small as described above, magnetization intensity of the carrier is relatively small and carrier adhesion to a photoconductor is caused, so that magnetization intensity of the carrier must be 60 emu/g or greater. When magnetization intensity of a magnetic carrier exceeds 80 emu/g, even if surface coating with resin is provided to the magnetic carrier, quality of a resulting image is deteriorated, which is not desirable. Magnetization intensity of a magnetic carrier can be adjusted by selecting the type and the quantity of an additive added to a core member of the carrier.

As described above, even when a magnetic carrier small in particle diameter and high in magnetization intensity is used in a developer, by adjusting electric characteristics of the developer and toner density of the developer, the developer can be one that suppresses suppress occurrence of light emission in ears of a magnetic brush in a development area and that can suppress an adverse effect of making the carrier small in particle diameter, i.e., occurrence of a spotted halftone image and a hollow image. Further, with a magnetic brush formed by magnetic carriers small in particle diameter, supply of toner to an electrostatic latent image on a photoconductor is made fine, so that a fine and high quality image can be obtained.

For toner of a developer of the present invention, such toner that includes at least heat reversible resin and a pigment such as carbon black, copper phthalocyanine, quinacridone, or bisazo pigment is preferable. For resin, styrene-acrylic or polyester resin is preferable. In addition, for a fixing auxiliary agent, wax such as polypropylene may be added. Also, a colorant that contains alloy may be added for controlling a toner charge amount. Further, surface treated silica, alumina, oxide such as titanium zinc, nitride, and carbide may be externally added. Furthermore, fatty acid metallic salt and fine-grain resin may be externally added together.

Toner is preferably small in volume-average particle diameter so that a high quality and fine image can be obtained. More specifically, a volume-average particle diameter of toner is preferably between 3 μm to 8 μm. In a two-component developer including toner and magnetic carriers, if a volume-average particle diameter of the toner is smaller than 3 μm, when the developer is stirred for a long time in a development device, the toner melts and adheres to surfaces of the magnetic carriers to decrease charge capability of the magnetic carriers, which is undesirable. When the volume-average particle diameter of toner is greater than 8 μm, it is hard to obtain a high quality and fine image, which is also undesirable.

Toner density in a developer is preferably between 3 wt % and 15 wt %. For reproducing a high quality halftone image in high quality by suppressing light emission in a magnetic brush, i.e., by suppressing conduction from a development sleeve to a photoconductor surface via the magnetic brush, toner density in a developer must be 3 wt % or greater. By making toner density in a developer 3 wt % or greater, sufficient image density can be obtained. On the other hand, if toner density in a developer exceeds 15 wt %, background fog is caused in an image, which is undesirable.

Figure 6:
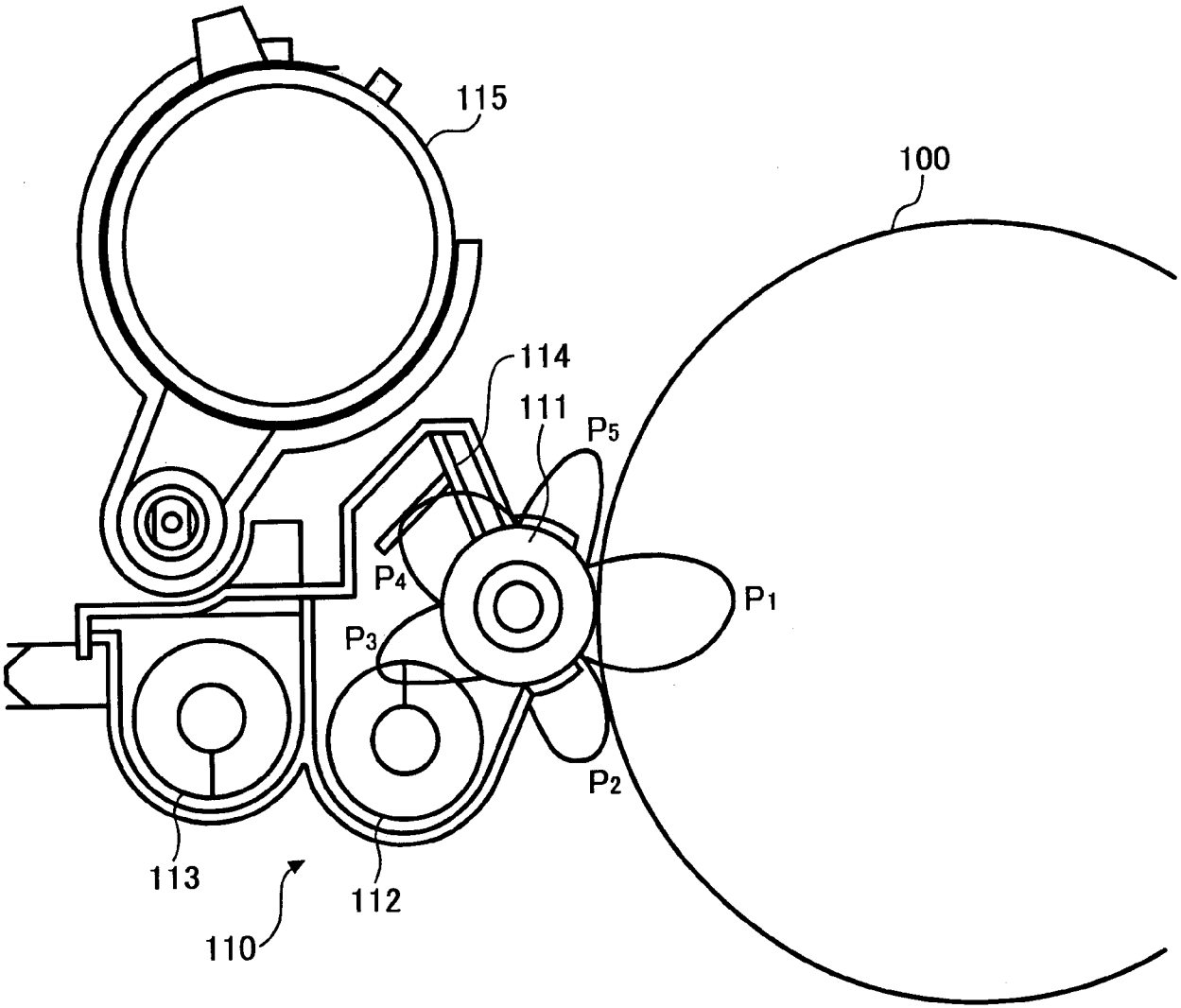
FIG. 6 is a diagram schematically illustrating a construction of a development device according to an embodiment of the present invention.

Now, description is made with respect to a development method and a development device of the present invention. FIG. 6 schematically illustrates a construction of the development device of the present invention. A development sleeve 111 is arranged inside of a development device 110 near a photoconductor 100, and a development area is formed by parts of the development sleeve 111 and the photoconductor 100 opposing each other. The development sleeve 111 is formed in a cylindrical shape with a non-magnetic substance such as aluminum, brass, stainless, conductive resin, etc. The development sleeve 111 is rotated in a clockwise direction by a rotation drive device (not illustrated).

A first convey screw 112 for scooping up a developer in a development case while stirring the developer in the development case and a second convey screw 113 for mixing toner supplied from a toner bottle 115 with the developer in the development case and conveying the developer mixed with the toner are arranged in an area of the development device 110 opposite the development area. Toner in the developer is charged with friction when the toner is mixed with the developer in the development case by the second convey screw 113 and when the developer mixed with the toner is stirred by the first convey screw 112.

A magnet roller member is fixedly provided inside of the development sleeve 111 to form a magnetic field such that the developer borne on the circumferential surface of the development sleeve 111 rises to form ears of the developer on the circumferential surface of the development sleeve 111. The magnet roller member includes a plurality of magnets arranged in a radial direction of the development sleeve 111, i.e., a primary development magnet with a magnetic force line P1, that raises ears of the developer in the development area, a developer scoop magnet with a magnetic force line P3, that scoops up the developer onto the development sleeve 111, developer convey magnets with magnetic force lines P4 and P5, that convey the scooped-up developer to the development area, and another developer convey magnet with a magnetic force line P2 that conveys the developer in the development area.

Here, the developer scoop magnet with the magnetic force line P3, the developer convey magnet with the magnetic force line 5, and the another developer convey magnet with the magnetic force line P2 constitute the N pole, and the primary development magnet with the magnetic force line P1 and the developer convey magnet with the magnetic force line P4 constitute the S pole. The another developer convey magnet with the magnetic force line P2 subsidizes formation of a magnetic force of the primary development magnet, and if the capability of the another developer convey magnet is insufficient, carrier adhesion to the photoconductor 100 is caused.

Magnetic carriers of a developer form ears on the development sleeve 111 along a magnetic force line emitted from the magnet roller member in a direction of a normal line, and charged toner adheres to the magnetic carriers forming the ears, and thereby a magnetic brush is formed. The magnetic brush is conveyed with rotation of the development sleeve 111 in the direction in which the development sleeve 111 is conveyed.

The linear velocity of the development sleeve 111 is preferably different from that of the photoconductor 100. By differentiating the linear velocity of the development sleeve 111 from that of the photoconductor 100, toner can be satisfactorily supplied to an electrostatic latent image formed on the surface of the photoconductor 100. Specifically, the ratio of the linear velocity Vs of the development sleeve 111 to the linear velocity Vp of the photoconductor, i.e., Vs/Vp, is preferably between 1.2 and 2.7.

A development gap, which is a space between the photoconductor 100 and the development sleeve 111, is set at 0.35 mm. If the development gap is too narrow, a magnetic brush is brought into contact with the photoconductor 100 in a broad area, so that slimming of a lateral line and dropping of a trailing end of an image easily occur. On the other hand, if the development gap is too broad, sufficient electric field intensity will not be obtained, so that an inferior image including isolated dots and density unevenness in a solid area is generated.

For obtaining sufficient electric field intensity, an applied voltage can be increased. In this case, however, an inferior image caused by discharging, such as the one in which a solid part is dropped, easily generated, which is undesirable. Therefore, the development gap is preferably set at less than or equal to 13 times a weight-average particle diameter of magnetic carriers.

A doctor blade 114 as a layer thickness regulation member for regulating a height of ears of a magnetic brush formed by magnetic carries, i.e., a thickness of a developer layer on the development sleeve 111, is provided upstream of the development area in the direction in which the developer is conveyed (i.e., in the clockwise direction in FIG. 6). A doctor gap, which is a space between the doctor blade 114 and the development sleeve 111, is set at 0.7 mm in this non-limiting example, so that a magnetic brush of the developer formed on the development sleeve 111 sufficiently rubs the surface of the photoconductor 100.

In the development method of the present invention, a two-component developer of the present invention having the above-described electrical characteristics is used. Thereby, without disturbing an electrostatic latent image on the photoconductor 100, a toner image of the latent image is precisely formed. At the same time, by using a magnetic carrier small in particle diameter, a magnetic brush is made fine and thereby toner is accurately supplied to the latent image, so that a high quality and fine image can be obtained.

Further, in the development method of the present invention, an electrostatic latent image on the photoconductor 100 is developed with loose toner separated from surfaces of magnetic carriers of a magnetic brush in the development area. When magnetic carriers gather to raise ears of a developer in the development area, toner adhering to surfaces of the magnetic carriers is caused to separate from the surfaces of the magnetic carriers as loose toner.

Figure 7:
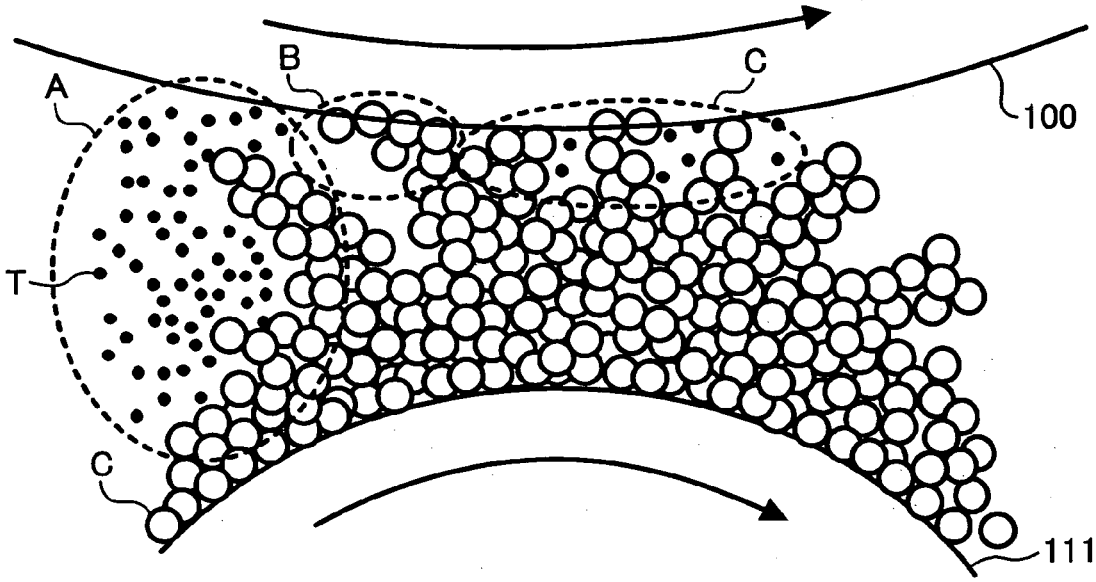
FIG. 7 is a diagram schematically illustrating a state of a two-component developer in a development area in a development method of the present invention.

FIG. 7 schematically illustrates a state of a two-component developer in a development area in the development method of the present invention. Here, the development area is an area in which, regardless of whether a magnetic brush has been formed by ears raised by gathered magnetic carriers C or whether a thin developer layer has been formed on the development sleeve 111, toner T in the developer moves toward the photoconductor 100. Herein below, the development area will be described for each of a front development area A, a middle development area B, and a rear development area C.

Figure 8:
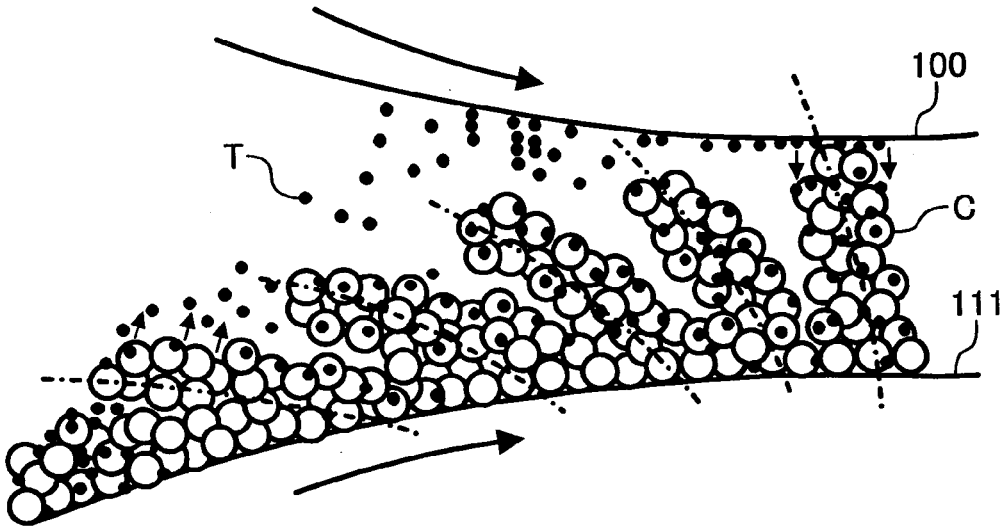
FIG. 8 is a diagram schematically illustrating a state that ears of magnetic carriers rise in a front development area of the development area.

The front development area A is an area in which the developer is conveyed by the developer convey magnet with the magnetic force line P5, a plurality of magnetic carriers C in the developer conveyed to a vicinity of the primary development magnet with the magnetic force line P1 gather, while holding toner T to form ears, and the ears of the magnetic carriers C rise along the magnetic force line P1 of the primary development magnet. FIG. 8 illustrates a state that ears of magnetic carriers C are raised in the front development area A. In a magnetic field acting in the front development area A, the developer convey magnet with the magnetic force line P5 and the primary development magnet with the magnetic force line P1 are reverse in polarity, so that a magnetic force line in the direction of a normal line is relatively small and that in the circumferential direction is relatively large. Therefore, a developer layer that is a thin agglomeration of the magnetic carriers C is formed between the primary development magnet with the magnetic force line P1 and the developer convey magnet with the magnetic force line P5. Toner T borne on each surface of the magnetic carriers C is buried in the developer layer, so that the quantity of toner T opposing the photoconductor 100 is very small. However, when the developer layer on the development sleeve 111 reaches a vicinity of the primary development magnet with the magnetic force line P1, several magnetic carriers C gather to form an ear and the ear rises. At this time, by the action of a magnetic field of the primary development magnet with the magnetic force line P1, which is relatively large, magnetic polarities of the magnetic carriers C are all in the same direction, and a repulsive force acts between adjacent magnetic carriers C. By the act of the repulsive force, the ear of the magnetic carriers C rises as if the developer layer is suddenly broken. At this time, a relatively large centrifugal force acts on toner T adhering to a surface of each magnetic carrier C, and thereby the toner T separates from the surface of the magnetic carrier C to be released to a development space as loose toner T. Because an electrostatic adherence force and a physical adherence force relative to the magnetic carrier C do not act on the loose toner T separated from the surface of the magnetic carrier C, the loose toner T can be easily moved with a development electric field, etc.

In the development method of the present invention, loose toner T can be generated by controlling a force acting on toner T on a surface of a magnetic carrier C with adjustment of powder characteristics such as particle diameter, etc. and magnetic characteristics such as magnetization intensity, etc. of the magnetic carrier C, magnetic flux density, etc., and shape characteristics such as width and shape of the primary development magnet with the magnetic force line P1. Further, by forming a magnetic brush including the loose toner T, a quantity of toner T adhering to an electrostatic latent image on the photoconductor 100 can be increased, so that a relatively high performance development method is realized. Further, by generating loose toner T that can develop an electrostatic latent image in a relatively weak electric field in the front development area A, a relatively high performance development method is realized.

In the middle development area B, ears of a magnetic brush strongly rub the surface of the photoconductor 100 to disperse toner T on the photoconductor 100, and thereby an electrostatic latent image on the photoconductor 100 is developed with the toner T.

In the middle development area B, an ear of a magnetic brush formed on the development sleeve 111 move moves at substantially the same speed as that of the development sleeve 111, except when the ear slips on the development sleeve 111. Therefore, when a height of the ear of the magnetic brush is greater than a distance between the development sleeve 111 and the photoconductor 100, the ear of the magnetic brush strongly contacts the photoconductor 100 with a combined speed of the speed of rising of the ear along the magnetic force line P1 of the primary development magnet and the linear speed of the development sleeve 111. Further, even if an ear of the magnetic brush has completely risen before the ear contacts the photoconductor 100, in an area wherein the space between the development sleeve 111 and the photoconductor 100 gradually decreases, at a point where the height of the ear is greater than the space between the development sleeve 111 and the photoconductor 100, the ear strongly contacts the photoconductor 100 with the linear velocity of the development sleeve 111 offset by that of the photoconductor 100.

At this time, toner T electrostatically adhering to a surface of a magnetic carrier C is separated from the surface of the magnetic carrier C with a shock given to the magnetic carrier C when the ear of the magnetic brush has strongly contacted the photoconductor 100. The separated toner T is moved to the photoconductor 100 with an inertia force of a centrifugal motion, an electric field of the electrostatic image on the photoconductor 100, and an electric field applied between the development sleeve 111 and the photoconductor 100 to develop an electrostatic latent image on the photoconductor 100.

In the rear development area C, ears of the magnetic brush move with rotation of the development sleeve 111 while rubbing the surface of the photoconductor 100, and toner T adhered to the magnetic carriers C develop the electrostatic latent image on the photoconductor 100.

Figure 9A:
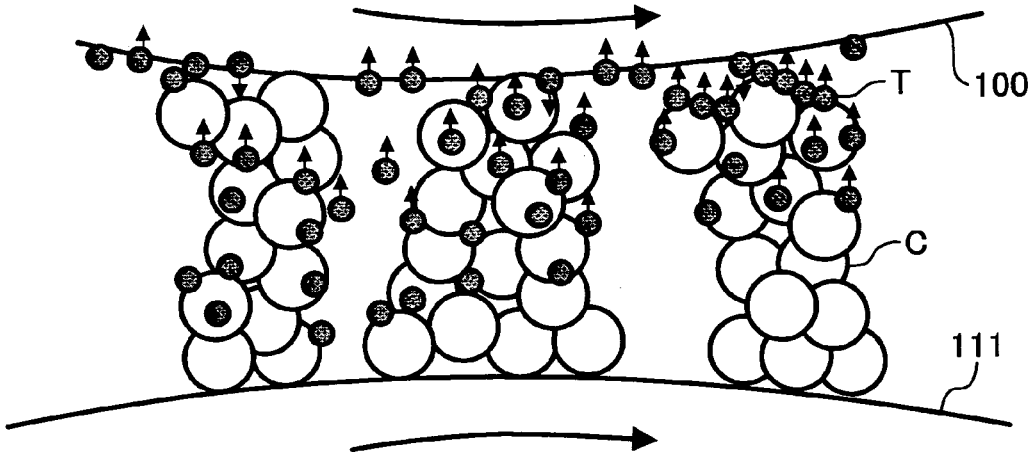
FIG. 9A and FIG. 9B are diagrams schematically illustrating states that toner moves to a photoconductor in a rear development area of the development area, FIG. 9A illustrating a state that toner moves over magnetic carriers when an electrostatic latent image on the photoconductor is developed with the toner, and FIG. 9B illustrating a state that toner moves to a non-image part area on the photoconductor.
Figure 9B:
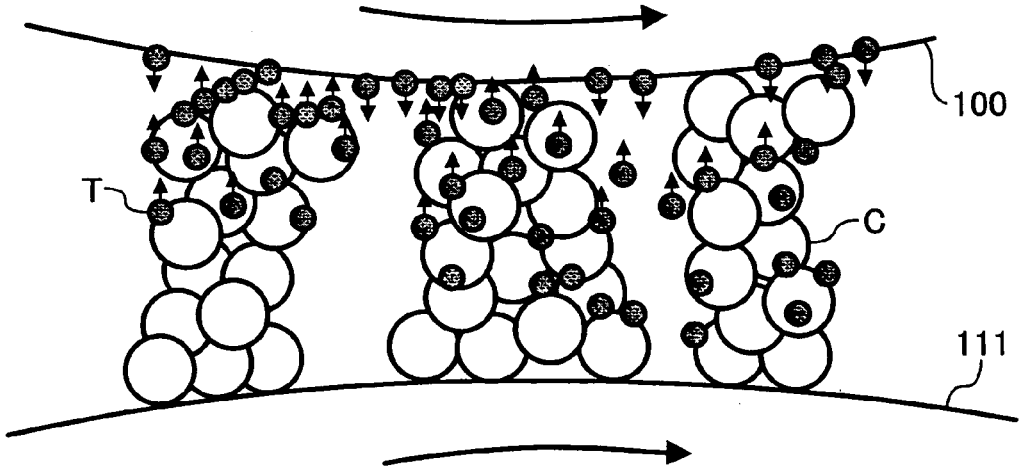

FIG. 9A and FIG. 9B schematically illustrate states that toner T moves to the photoconductor 100 in the rear development area C. FIG. 9A illustrates a state that toner T moves over magnetic carriers C when an electrostatic latent image on the photoconductor 100 is developed with the toner T. FIG. 9B illustrates a state that toner T moves to a non-image part area on the photoconductor 100. A DC voltage or a voltage in which a DC voltage has been superimposed with an AC voltage is generally applied between the development sleeve 111 and the photoconductor 100 for development. Toner T moves toward the electrostatic latent image on the photoconductor 100 as illustrated in FIG. 9A by an electrostatic force, and thereby the electrostatic latent image is developed with the toner T.

In the rear development area C, because some toner T has already been already consumed for development in the front development area A and the middle development area B, toner T adhering to surfaces of magnetic carriers C has decreased decreases in quantity, so that ears of the developer in which magnetic carriers C are exposed exist. When these ears rub the photoconductor 100, as illustrated in FIG. 9B and strongly contact toner T moved onto the photoconductor 100, the toner T on the photoconductor 100 is caused to be absorbed to surfaces of the exposed magnetic carriers C of the ears, with a shock applied to the toner T when the ears strongly contact the photoconductor 100 and an electrostatic coulomb force generated due to respective charges reverse in polarity. Thereby, the toner T is separated from the photoconductor 100. In this case, toner T adhered to a non-image part on the photoconductor 100, in which an electric field causing toner T to adhere to the photoconductor 100 is relatively small, is mainly separated from the photoconductor 100. Thus, background soiling in the non-image part is prevented, so that an image of high quality is obtained.

However, if an ear of a magnetic brush in which magnetic carriers C are exposed as described above rubs an image part on the photoconductor 100 that is relatively low in image density, when electric resistance of the magnetic carriers C is relatively low, a current easily flows. Therefore, in this case, the image part or an undeveloped electrostatic latent image on the photoconductor 100 is electrostatically disturbed. It is presumed that density unevenness of a spotted pattern in a halftone image is caused by the above-described phenomenon. Accordingly, in the development method of the present invention, by using the two-component developer of the present invention described above, occurrence of density unevenness of a spotted pattern in a halftone image is avoided, and by using loose toner T for development, a relatively high performance is obtained.

Figure 10:
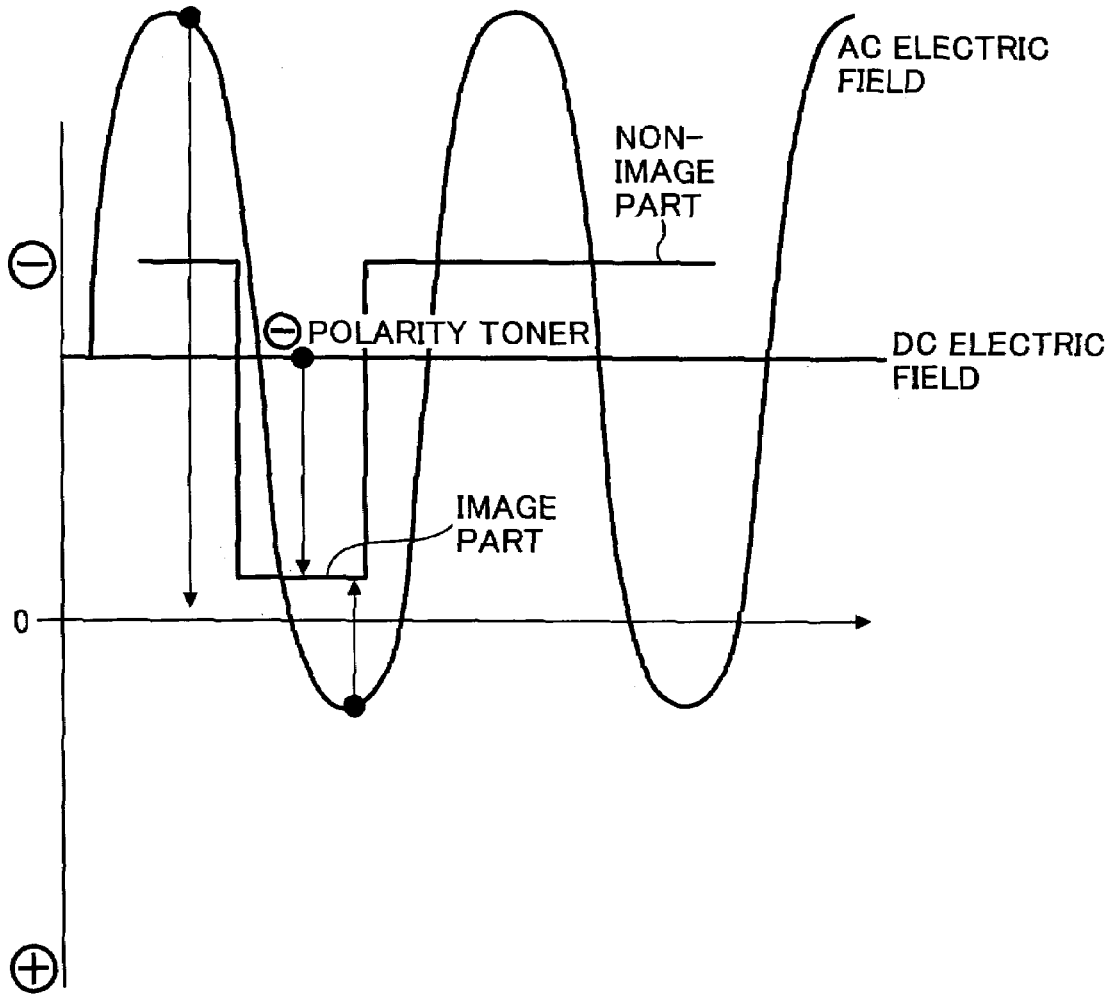
FIG. 10 is a diagram schematically illustrating a state that an alternating electric field of DC and AC voltages is applied in a reversal development method.

Further, for a development electric field, which is generated by an applied development bias, an alternate electric field generated by superimposing DC and AC voltages with each other may be used. FIG. 10 schematically illustrates a state that an alternate electric field of DC and AC voltages is applied in a reversal development method. An OPC photoconductor in which an organic pigment is used as a charge generation material is generally charged to negative polarity. When writing an electrostatic latent image with laser light on the photoconductor charged to negative polarity, an image part is exposed with the laser light to decrease a charge amount. Therefore, a charge of an image part is neutralized by a hole generated from the charge generation pigment, and as illustrated in FIG. 10 a potential of the image part decreases. Toner T charged to negative polarity is moved to the image part by the electric field applied between the development sleeve 111 and the photoconductor 100. Further, due to the applied alternate electric field, the toner T moved onto the photoconductor 100 moves in an oscillating manner to be gradually and aligned with the electrostatic latent image, so that an image of high quality is obtained. Furthermore, in an area where an ear of a magnetic brush is close to the photoconductor 100, an electric field enhanced by magnetic carriers C is generated. Therefore, in such an area, toner T more drastically moves in an oscillating manner, so that the toner T is more aligned with the electrostatic latent image, and thereby an image of higher quality is obtained.

The above-described development device may be mounted to an image forming apparatus including an image bearing member configured to bear an image, a charge device configured to uniformly charge the surface of the image bearing member, an exposure device configured to expose the charged surface of the image bearing member to form an electrostatic latent image, and a transfer device configured to transfer a toner image formed on the image bearing member to a transfer member. With the above-described development device of the present invention, a magnetic brush can be made fine by using magnetic carriers small in particle diameter, and thereby supplying of toner to an electrostatic latent image can be made precise, so that an image of high quality and enhanced fineness can be provided.

Now, a result of evaluating examples of a two-component developer of the present invention and comparative examples are described.

EXAMPLE 1

A two-component developer of Example 1 was obtained by mixing a magnetic carrier 1 that was 35 μm in weight-average particle diameter with polymer toner that was 5 μm in number-average particle diameter so that the toner density of the developer was 3 wt %. The magnetic carrier 1 was obtained by coating the surface of manganese ferrite as a core member in which bismuth (Bi) compound as a resistance adjuster was added by 0.5 wt % with silicone resin containing carbon black in a layer 0.31 μm in thickness. The polymer resin included as primary components polyester resin and carbon black.

EXAMPLE 2

A two-component developer of Example 2 was substantially the same as that of Example 1, except that the density of toner was 5 wt %.

EXAMPLE 3

A two-component developer of Example 3 was obtained by mixing a magnetic carrier 2 that was obtained in a similar manner as in Example 1, except that the content of carbon black added to the silicone resin coating the surface of the core member of the magnetic carrier 2 is 1.25 times of that in the magnetic carrier 1 of Example 1 with polymer toner including as primary components polyester resin and carbon black and being 5 μm in average particle diameter such that the toner density in the developer was 5 wt %.

Comparative Example 1

A two-component developer of Comparative Example 1 was obtained by mixing a magnetic carrier 3 that was obtained in a similar manner as in Example 1, except that manganese magnesium ferrite was used instead of manganese ferrite and a resistance adjuster was not added with polymer toner including as primary components polyester resin and carbon black and being 5 μm in number-average particle diameter so that density of the toner was 5 wt %.

Comparative Example 2

A two-component developer of Comparative Example 2 was obtained by mixing a magnetic carrier 4 obtained in a similar manner as in Example 1, except that a resistance adjuster was not added to manganese ferrite with polymer toner including as primary components polyester resin and carbon black and being 5 μm in number-average particle diameter so that the toner density of the developer was 5 wt %.

With respect to the above-described two-component developers of Examples 1, 2 and 3 and Comparative Examples 1 and 2, the following characteristics were evaluated.

1) Magnetization Intensity of Magnetic Carriers

Measurement was performed in a magnetic field of 1 kOe using a vibrating sample magnetometer (VSM manufactured by TOEI Industry Co., Ltd.).

2) Number of Times of Light Emission

The number of times of light emission observed in a magnetic brush was counted in a video of a development area photographed with a high-speed camera using the apparatus illustrated in FIG. 2. Setting conditions of the apparatus were as follows:

Distance between the development sleeve 2 and the developer regulation member: 0.7 mm. Degree of accuracy was set within ±0.01 mm based on tolerance of parts of the development sleeve 2, however, margin of fluctuation relative to this value was 0.05 mm.

Distance between the quasi-photoconductor 1 and the development sleeve 2: 0.35 mm. Degree of accuracy was set within ±0.01 mm based on tolerance of parts of the quasi-photoconductor 1, however, margin of fluctuation relative to this value was 0.1 mm.

Observation area: the entire part of the development nip (about 3 mm).

Linear velocity of the quasi-photoconductor 1: 245 mm/sec.

Linear velocity of the development sleeve 2: 515 mm/sec.

Applied voltage between the development sleeve 2 and the quasi-photoconductor 1: 450V DC superimposed with an AC of 9 kHz in frequency and 900V in Vpp.

3) Dynamic Resistance Value

A development sleeve bearing a developer in a state of a magnetic brush was rotated and a DC voltage was applied between the development sleeve and a quasi-photoconductor of aluminum in a stopped condition, and a dynamic resistance value was measured from the applied voltage and a current flowed at that time. The voltage was measured with a high-voltage power source model 610 manufactured by TERK Technologies, and the current was measured with a digital multimeter 177 manufactured by Keithley Instruments, Inc. A voltage value when a change in the current value with increase in the measured voltage has reached $1.0\times10^{-6}$ A/V was set as a dielectric breakdown voltage. Other measurement conditions were as follows:

Distance between the development sleeve and a developer regulation member: 0.7 mm.

Distance between the development sleeve and the quasi-photoconductor of aluminum: 0.35 mm.

Development nip width: 3 mm.

Linear velocity of the development sleeve: 515 mm/sec.

Linear velocity of the quasi-photoconductor of aluminum: 0 mm/sec.

4) Density Unevenness of a Spotted Pattern in a Halftone Image:

A halftone image was obtained using a popular image forming apparatus provided with a two-component development device. An electrostatic latent of the halftone image was formed with a method of shifting the function of preventing toner adhesion with a development bias toward the development side by slightly decreasing a charge potential of an OPC photoconductor. Development conditions were as follows:

Distance between the OPC photoconductor and a development sleeve: 0.35 mm.

Development nip width: 3 mm.

Linear velocity of the photoconductor: 245 mm/sec.

Linear velocity of the development sleeve: 515 mm/sec.

Applied voltage between the development sleeve and the OPC photoconductor: a DC voltage superimposed with an AC voltage of 9 kHz in frequency and 900V in Vpp. The DC voltage and a surface potential of the OPC photoconductor were adjusted so that image density of a formed halftone image is about 0.8.

Obtained halftone images were evaluated with respect to density unevenness of a spotted pattern. The halftone images were rated at intervals of 0.5, while halftone images having no density unevenness of a spotted pattern being rated at 5.0, according to a degree of density unevenness of a spotted pattern. Halftone images rated at 3.0 or above are satisfactory images from a practical standpoint.

5) Hollow Image

A sample image in which a solid part was included in a halftone part thereof was developed under the same development conditions as the ones described above. Image density of an edge part of the solid part was measured to obtain the graph illustrated in FIG. 5, and an area of a shaded part in the graph was converted to a numerical value as an apparent dropping quantity SH. At this time, for making evaluation conditions constant, the sample image was obtained by adjusting the DC voltage and the surface potential of the OPC photoconductor so that densities of the solid part and the halftone part were 1.7 and 1.8, respectively. The value of the apparent dropping quantity SH that is preferable from a practical standpoint is 10 or smaller.

A result of the above-described evaluation is indicated in Table 1.

TABLE 1

| | Magnetization intensity of magnetic carrier[(1)] (emu/g) | Number of times of light emission (times/sec) | Dielectric breakdown voltage (V) | Density unevenness of a spotted pattern | Hollow image (apparent dropping quantity) |
|---|---|---|---|---|---|
| Example 1 | 65 | 10 | 1250 | 4.0 | 9.5 |
| Example 2 | 65 | 3 | 1300 | 4.5 | 9.5 |
| Example 3 | 65 | 10 | 1100 | 3 | 8.8 |
| Comparative Example 1 | 67 | 500 | 350 | 1.5 | 3.7 |
| Comparative Example 2 | 68 | 100 | 800 | 2 | 2.0 |

[(1)]Magnetization Intensity in a Magnetic Field of 1kOe

In Table 1, with respect to all of Examples 1, 2, and 3 and Comparative Examples 1 and 2, magnetization intensity of the magnetic carrier is greater than 60 emu/g. That is, even though the magnetic carrier is small, i.e., 35 μm in particle diameter, each developer does not cause carrier adhesion.

The number of times of light emission observed in a magnetic brush is 10 times/sec or smaller with respect to Example 1, Example 2, and Example 3. In contrast, the number of times of light emission in a magnetic brush was 500 times/sec with respect to Comparative Example 1 and 100 times/sec with respect to Comparative Example 2, which are very large. In the developers of Example 1 and Example 2, the same magnetic carrier was used and the toner density was changed, and it was confirmed that the number of times of light emission was smaller in the developer of Example 2 that was higher in toner density than the developer of Example 1. Here, results of only two points at 3 wt % and 5 wt % in toner density have been indicated. However, in measuring the number of times of light emission while gradually changing the toner density from a low level to a high level, it was observed that the number of times of light emission decreases as the toner density increases, and a satisfactory result that the number of times of light emission is 1 time/sec was obtained with the toner density at 7 wt %.

Thus, by adjusting a ratio of a resistance adjuster added to a magnetic carrier or that of a resin component coated on the surface of the magnetic carrier, resistance of the magnetic carrier can be adjusted, and thereby the number of times of light emission in a magnetic brush can be decreased. It has been found that by using the developer of Example 1, Example 2, or Example 3, conduction to a photoconductor passing a magnetic brush can be suppressed.

Figure 11:
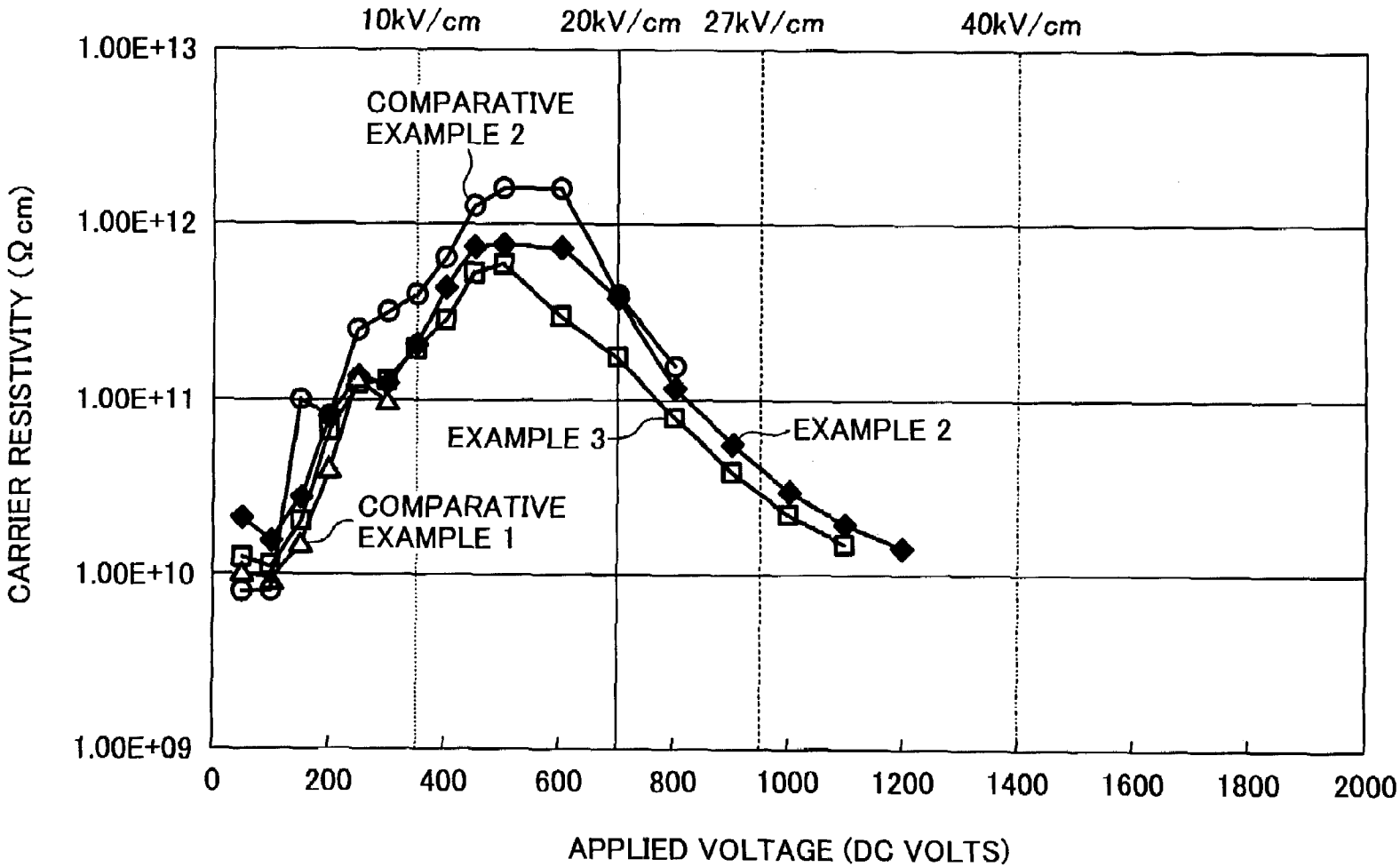
FIG. 11 is a graph indicating results of measuring dynamic resistance values.

Next, results of measuring dynamic resistance values of the developers are described. FIG. 11 is a graph indicating the results of measuring dynamic resistance values of the developers of Examples 2 and 3 and Comparative Examples 1 and 2. With respect to each of the developers, when an applied voltage was gradually increased, a flowing current decreased, and a resistivity value of the carrier increased. It can be conceived that because a development bias current is offset with movement of charged toner included in a magnetic brush, an apparent resistance increases. Thereafter, the resistivity value of the carrier is maximized when the applied voltage is between 500V and 700V and the electric field intensity is between 15 kV/cm and 20 kV/cm, i.e., when movement of charged toner saturates, and thereafter, the measured current increases until dielectric breakdown occurs, and the resistivity value decreases. The last plot at the high-voltage side in the graph indicates a point where dielectric breakdown occurred. At this time, a voltage value when the change in the current value with increase of the measured voltage has reached $1.0\times10^{-6}$ A/V is set as the dielectric breakdown voltage, and a measured value is indicated in Table 1.

From the graph of FIG. 11, with respect to Example 2 and Example 3, the dynamic resistance values were in a range between $1.0\times10^{10}$ Ω cm and $5.0\times10^{12}$ Ωcm in an area where the electric field intensity is between 10 kV/cm and a point where dielectric breakdown is caused. Further, areas where dielectric breakdown occurred are those areas where the electric field intensity was 27 kV/cm or greater.

On the other hand, with respect to Comparative Example 1 and Comparative Example 2, although dynamic resistance values were in the above-described range, dielectric breakdown occurred in areas where the electric field intensity was 27 kV/cm or smaller.

By comparing the above-described results of measuring dynamic resistance values with rated ranks of density unevenness of a spotted pattern and values of dropping quantities of hollow images in Table 1, with respect to the developers of Example 2 and Example 3, the dynamic resistance values were in an appropriate range and the dielectric breakdown voltages were large. As a result, occurrence of density unevenness of a spotted pattern was suppressed, and further, a satisfactory value of dropping quantity of a hollow image (i.e., 10 or below) was obtained.

On the other hand, with respect to the developers of Comparative Example 1 and Comparative Example 2, the dynamic resistance values were in an appropriate range and thereby the evaluation results as to a hollow image were satisfactory. However, the dielectric breakdown voltages were small and thereby the rated ranks of density unevenness of a spotted pattern were deteriorated.

Evaluation of density unevenness of a spotted pattern in a halftone image is correlated with the number of times of light emission in a magnetic brush in a development area, photographed with a high-speed camera. That is, it is understood that by using the developer of Example 2 or Example 3 in which the number of times of light emission in a magnetic brush is relatively small, charge injection to the surface of a photoconductor can be suppressed and that a rated rank of density unevenness of a spotted pattern in a halftone image is satisfactory.

Now, an image forming apparatus according to a preferred embodiment of the present invention is described. The image forming apparatus includes a photoconductor serving as an image bearing member, and arranged around the photoconductor are a charging device, an exposure device, a development device, a transfer device, and a cleaning device (in that order). The image forming apparatus further includes a sheet feed/convey device configured to feed a transfer sheet from a sheet tray, and a fixing device configured to fix a toner image transferred onto the transfer sheet to the transfer sheet. In the image forming apparatus configured as described above, after the surface of the photoconductor, which is rotated, has been uniformly charged by the charging device, the charged surface of the photoconductor is illuminated by a laser light of the exposure device modulated according to image information, and thereby a latent image according to the image information is formed on the photoconductor. Toner, which has been charged, is caused to adhere to the latent image on the photoconductor, and thereby a toner image is formed on the photoconductor. A transfer sheet is fed from the sheet tray by the sheet feed/convey device, and is conveyed to a transfer part where the photoconductor and the transfer device oppose each other. The transfer device applies to the transfer sheet an electric charge opposite to that of the toner image on the photoconductor, and thereby the toner image on the photoconductor is transferred onto the transfer sheet. Subsequently, the transfer sheet is separated from the photoconductor, and is conveyed to the fixing device. The toner image is fixed to the transfer sheet by the fixing device, and thereby an image is obtained.

Figure 12:
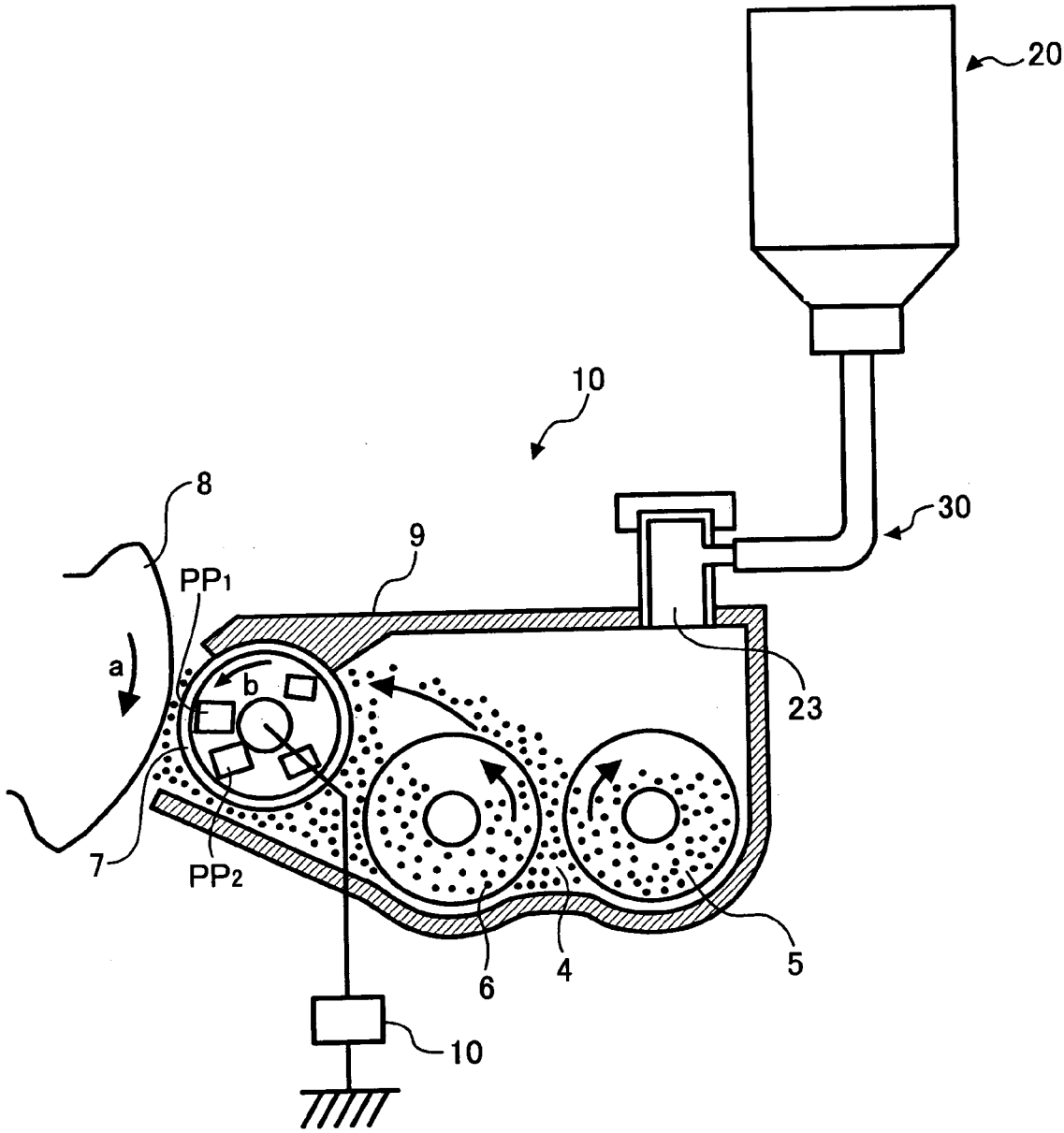
FIG. 12 is a schematic diagram illustrating an exemplary construction of a development device used in an image forming apparatus according to an embodiment of the present invention.

FIG. 12 is a schematic drawing illustrating an exemplary construction of a development device 10 used in the above-described image forming apparatus. The development device 10 is arranged beside a photoconductor 8, and includes a non-magnetic development sleeve 7 serving as a developer bearing member bearing on a surface thereof a two-component developer including toner and magnetic carriers (hereinafter sometimes referred to simply as a developer). The development sleeve 7 is attached such that a part thereof is exposed through an opening formed at a part of a development case at the side of the photoconductor 8, and is driven by a drive device (not shown) to rotate in the direction indicated by an arrow b in FIG. 12. A magnetic roller (not shown) serving as a magnetic field generation device, which includes stationary magnets, is fixedly arranged inside of the development sleeve 7. The development device 10 also includes a doctor 9, which is a rigid body functioning as a developer regulation member for regulating a quantity of a developer borne on the development sleeve 7. A developer accommodating part 4 accommodating the developer is formed at the upstream side in the rotating direction of the development sleeve 7 relative to the doctor 9, and first and second stirring screws 5 and 6 for stirring and mixing the developer in the developer accommodating part 4 are provided in the developer accommodating part 4. Also, a toner replenish opening 23 is arranged above the developer accommodating part 4, and a toner hopper 20 filled with toner to be replenished to the developer accommodating part 4 and a toner convey device 30 connecting the toner replenish opening 23 with the toner hopper 20 are provided.

In the development device 10 configured as described above, the first and second stirring screws 5 and 6 rotate, and thereby the developer in the developer accommodating part 4 is stirred and toner and magnetic carriers of the developer are charged by friction to respective polarities opposite to each other. The stirred developer is supplied to the peripheral surface of the development sleeve 7, the supplied developer is borne on the peripheral surface of the development sleeve 7, and with rotation of the development sleeve 7 the developer borne on the peripheral surface of the development sleeve 7 is conveyed in the rotating direction (the arrow b direction) of the development sleeve 7. Subsequently, the developer borne on the peripheral surface of the development sleeve 7 is regulated in quantity by the doctor 9, and the developer borne on the periphery surface of the development sleeve 7 after having been regulated in quantity is conveyed to a development area where the photoconductor 8 and the development sleeve 7 oppose each other. In the development area, the toner in the developer electrostatically moves to a latent image on the surface of the photoconductor 8, and the latent image is visualized as a toner image.

In the above-described image forming apparatus, for realizing a high image quality, a magnetic carrier having a weight-average particle diameter of 20 μm or greater but not exceeding 60 μm is used. By making the particle diameter of the magnetic carrier 60 μm or smaller, a trace of an ear and surface roughness in a half-tone image caused by the magnetic carrier can be prevented. That is, deterioration of an image in graininess can be prevented, and as a result, enhancement of an image quality can be realized. Further, by making the particle diameter of the magnetic carrier 20 μm or greater, mobility of the developer is prevented from being excessively deteriorated and stress to the developer is prevented from being excessively increased.

On the other hand, as a magnetic carrier is smaller in particle diameter, magnetization of the carrier is decreased, so that adhesion of the carrier to a photoconductor easily occurs. In addition, for satisfying the demand for miniaturization of apparatuses, for the photoconductor 8, a photoconductor having a diameter of 60 mm or smaller is used, and for the development sleeve 7, a development sleeve having a diameter of 30 mm or smaller is used. With the use of such a photoconductor and a development sleeve having relatively small diameters, respectively, the magnetic holding force of a magnetic brush relative to carriers borne on ears of the magnetic brush is decreased at a downstream (the exit side) of the development area, so that adhesion of the carriers to the photoconductor 8 easily occurs. Due to occurrence of adhesion of carriers to the photoconductor 8, deterioration of the photoconductor 8 and members arranged to contact the photoconductor 8, such as a cleaning blade (not shown) for the photoconductor 8, etc., are accelerated, and a white spot caused by adhesion of carriers to the photoconductor 8 is generated in an image area. Therefore, in the image forming apparatus of the present invention, in which a carrier relatively small in particle diameter is used, as described below, adhesion of the carrier to the photoconductor 8 is suppressed and at the same time an adverse effect, which may be caused when a countermeasure is taken for preventing adhesion of the carrier to the photoconductor 8, is suppressed within an allowable range.

In the above-described image forming apparatus, for the magnetic carrier of the two-component developer, a magnetic carrier having the following characteristics is used. The saturation magnetization in a magnetic field of 1 kOe is 66 emu/g or greater but not exceeding 100 emu/g, and the static resistance when a bias of 1000V has been applied is $10^9$ Ωcm or greater but not exceeding $10^{14}$ Ωcm. Further, the carrier has a coating film including a bonding resin and particles, and a diameter D of the particles and a thickness h of the bonding resin film satisfies the relation: ($1<D/h<10$). Furthermore, only a DC bias is applied as the development bias and an AC bias is not applied.

By setting saturation magnetization of the magnetic carrier in a magnetic field of 1 kOe to 66 emu/g or greater, the magnetic holding force of a magnetic brush relative to the surface of the magnetic brush by the above-described magnetic roller serving as the magnetic field generation device is increased. Thereby, the carrier cannot easily leave tips of the magnetic brush, so that adhesion of the carrier to the photoconductor 8 can be suppressed. By setting saturation magnetization of the magnetic carrier in a magnetic field of 1 kOe to 100 emu/g or smaller, ears of the magnetic brush are prevented from being excessively hardened to cause a trace of the ears to appear on an image. Also, releasing of the developer from the development sleeve 7 prevented, thereby minimizing a need to replace developer on the developer sleeve 7. Thereby, unevenness in toner density in the developer on the development sleeve 7 is prevented so that unevenness in image density is prevented.

Further, the static resistance of the magnetic carrier is set to be in a relatively low range, i.e., $10^9$ Ωcm or greater but not exceeding $10^{14}$ Ωcm. The static resistance and the saturation magnetization of a magnetic carrier have a certain correlation, and if the saturation magnetization is increased, the static resistance is decreased. However, if the static resistance is made excessively small, electric charge easily leaks, and a spotted halftone image is easily generated due to such leaking. Therefore, for avoiding this problem, the lower limit of the static resistance is set at $10^9$ Ωcm. Further, even when the saturation magnetization is set at 66 emu/g or greater, the static resistance may be relatively high. The inventors of the present invention have found that if the static resistance is excessively high, a hollow image beyond an allowable range occurs. Therefore, the static resistance of the magnetic carrier is set at $10^{14}$ Ωcm or smaller, so that a hollow image is suppressed within the allowable range.

Further, only a DC bias is applied to the development sleeve 7 by a power source 10 serving as a development electric field generation device connected with the development sleeve 7. That is, because the static resistance of the magnetic carrier is set relatively low, as described above, causing the magnetic carrier to easily leak, an AC bias is not applied (which might otherwise cause leaking), and leaking hardly occurs.

As described above, in the image forming apparatus of the present invention, for achieving enhancement of an image quality, a carrier having a relatively small particle diameter is used, and for preventing adhering of the carrier to a photoconductor, which easily occurs due to the carrier having a relatively small particle diameter, saturation magnetization of the carrier is set relatively high. Further, for avoiding a spotted halftone image and a hollow image, that easily occur due to relatively high saturation magnetization of the carrier, from exceeding an allowable range, a range of static resistance of the magnetic carrier and a component of the development bias are specified.

Further, the image forming apparatus of the present invention is configured such that occurrence of density unevenness in a halftone image is suppressed to achieve a higher image quality. The width of a development gap, which is a distance between the photoconductor 8 and the development sleeve 7 in the development area, affects occurrence of density unevenness in a halftone image. If the development gap is too large, an electric field from the development sleeve 7 does not reach the photoconductor 8, so that a so-called turning over electric field is easily formed. In this case, toner does not adhere to an image area uniformly, and density unevenness occurs in particular in a halftone image. When density unevenness occurs in a halftone image, it is described as deteriorated graininess of an image. Generally, when a spotted halftone image occurs, graininess of an image is deteriorated. However, sometimes graininess of an image is deteriorated even when a spotted halftone image is not generated. Therefore, it is preferable that graininess of an image is made satisfactory for obtaining a higher quality image.

Now, results of evaluation of image formation under various conditions in the above-described image forming apparatus are described. As indicated in Table 2 below, the evaluation has been made with respect to five non-limiting examples of condition patterns in which the above-described conditions of the present invention relative to saturation magnetization, static resistance and particle diameter of carriers, biasing, and a development gap are satisfied, and seventeen comparative examples of condition patterns in which the above-described conditions of the present invention are not satisfied. It is needless to say that the present invention is not limited to these five examples of condition patterns.

First, setting conditions of a full-color printer as the image forming apparatus used in the evaluation are described.

The setting conditions of the full-color printer with respect to five examples of condition patterns of the present invention were as follows:

Photoconductor linear velocity: 350 mm/sec.

Photoconductor diameter: 60 mm.

Development sleeve/photoconductor linear velocity ratio: 2.

Developer scooping up quantity: 50 mg/cm$^2$.

Development sleeve diameter: 25 mm.

Primary pole (PP1) angle: 6°.

Primary pole (PP1) magnetic flux density: 120 mT.

Primary pole downstream side pole (PP2) magnetic flux density: 110 mT.

Charge potential VD: −600V.

After exposure potential VL: −60V.

Development bias Vb: −430V.

The setting conditions of the full-color printer with respect to seventeen comparative examples of condition patterns are as follows:

Photoconductor linear velocity: 350 mm/sec.

Photoconductor diameter: 60 mm.

Development sleeve/photoconductor linear velocity ratio: 2.

Developer scooping up quantity: 50 mg/cm$^2$

Development sleeve diameter: 25 mm.

Primary pole (PP1) angle: 6°.

Primary pole (PP1) magnetic flux density: 120 mT.

Primary pole downstream side pole (PP2) magnetic flux density: 110 mT.

Charge potential VD: −420V.

After exposure potential VL: −60V.

Development bias Vb: −250V.

In measuring magnetic flux densities, a magnetic force distribution measure instrument (a three-dimensional magnetism measure instrument manufactured by EXCEL-SYSTEM, CO. LTD.) and a gauss meter (manufactured by AD-S, CO. LTD.) were used, and a sleeve-prodding method was used in measurement.

The development sleeve 7 was processed with V-shaped grooving. The doctor 9 was made of a rigid and magnetic material. The doctor 9 may be constructed not only by a metal material such as steel and stainless, but also by a resin material in which magnetic particles such as ferrite or magnetite are compounded, for example. Further, instead of constructing the doctor 9 with a magnetic material, the doctor 9 may be constructed with a non-magnetic member, and a magnetic member such as a metal plate attached directly or indirectly to the non-magnetic member, for example.

Next, magnetic carriers used with respect to five examples of the present invention and seventeen comparative examples are described.

Magnetic carriers used in the developer with respect to five examples of the present invention were obtained as described below.

By dispersing the following materials by a homogenizing mixer for 10 minutes, a coating film forming solution was blended.

Acrylic resin solution (solid content; 50% by weight): 56.0 parts.

Guanamine solution (solid content; 77% by weight): 15.6 parts.

Alumina particle (particle diameter; 0.31 μm, resistivity; $10^{14}$ Ωm): 160.0 parts.

Toluene: 900 parts.

Butylcellosolve: 900 parts.

The coating film forming solution was applied to calcinated ferrite powder having a predetermined average particle diameter as a core member with a tumbled fluidized bed coater (SPIRA COTA manufactured by OKADA SEIKO, CO., LTD.) so that the thickness of a coating film was 0.15 μm. Carriers thus obtained were dehydrated and then were left in an electric furnace for 1 hour at 150° C. to be calcinated. After cooling the calcinated carriers, a bulk of the ferrite powder was fragmented using a comb with a tooth-gap of 100 μm, and thereby the carriers are obtained.

The ratio of the diameter D (=0.3 μm) of particles included in the coating film of the carriers and the thickness h (=0.15 μm) of the coating film was 2.

Magnetic carriers used in the developer with respect to 17 comparative examples were obtained as described below.

By dispersing the following materials by a homogenizing mixer for 10 minutes, a coating film forming solution was blended.

Acrylic resin solution (solid content; 50% by weight): 56.0 parts.

Guanamine solution (solid content; 77% by weight): 15.6 parts.

Toluene: 900 parts.

Butylcellosolve: 900 parts.

The coating film forming solution was applied to calcinated ferrite powder having a predetermined average particle diameter as a core member with a tumbled fluidized bed coater (SPIRA COTA manufactured by OKADA SEIKO, CO LTD.) so that the thickness of the coating film is 0.15 μm. Carriers thus obtained were hydrated and then were left in an electric furnace for 1 hour at 150° C. to be calcinated. After cooling the calcinated carriers, a bulk of the ferrite powder was fragmented using a comb with a tooth-gap of 100 μm, and thereby the carriers were obtained.

A coating film covering the surface of a carrier can be observed by observing a cross section of the carrier with a transmission electronic microscope. Therefore, a thickness of the coating film was obtained by averaging values of thickness of cross sections of the coating film thus observed.

The coating film of the carriers used with respect to seventeen comparative examples did not include particles. Accordingly, the ratio of the diameter D of particles included in the coating film of the carriers and the thickness h of the coating film described above with respect to the carriers used in relation to five examples of the present invention cannot be applied.

Table 2 indicates the results of evaluation of image formation with respect to five examples of conditions patterns of the present invention, Examples E1 through E5, and seventeen comparative examples of condition patterns, Comparative Examples CE1 through CE17. The evaluation has been made with respect to a spotted halftone image, a hollow image, graininess, and adhesion of carriers to a photoconductor. When DC is specified in the column of bias, it indicates that only a DC bias was applied as a development electric field, and when AC is specified in the column of bias, it indicates that an AC bias was superimposed on a DC bias. The AC bias is 4.5 kHz in frequency, 0.9 kV in Vpp, and 35 in duty. In Table 2, the development gap is labeled as PG.

Saturation magnetization of carriers was measured using a BHU-U type magnetization measure apparatus (manufactured by Riken Denshi. Co. Ltd.). About 1.0 gr of a measuring sample was put in a cell 7 mm in internal diameter and 10 mm in height to be set in the measuring apparatus. The applied magnetic field was gradually increased to 1 kOe, and magnetization intensity in a magnetic field of 1 kOe was obtained.

In the column of evaluation results, ◎ indicates a highly satisfactory result, ○ indicates a satisfactory result, Δ indicates an unsatisfactory result, and X indicates an extremely unsatisfactory result. The setting conditions of Comparative Example CE10 satisfy the conditions of the present invention, but CE10 is listed as a comparative example.

TABLE 2

| | Conditions | | | | | Evaluation Results | | | |
|---|---|---|---|---|---|---|---|---|---|
| | | | Statis | | | | | | |
| | Saturation Magnetization (emu/g) | Particle Diameter (μm) | Resistance (1000V, Ω cm) | PG (mm) | Bias | Spotted Halftone Image | Hollow Image | Graininess | Adhesion of Carrier |
| E1 | 66 | 35 | $10^{13}$ | 0.3 | DC | ◎ | ○ | ○ | ○ |
| E2 | 75 | 60 | $10^{12}$ | 0.3 | DC | ◎ | ○ | ○ | ◎ |
| E3 | 66 | 35 | $10^{14}$ | 0.4 | DC | ◎ | ○ | ○ | ○ |
| E4 | 70 | 35 | $10^{11}$ | 0.2 | DC | ◎ | ◎ | ◎ | ○ |
| E5 | 70 | 35 | $10^{9}$ | 0.3 | DC | ○ | ◎ | ◎ | ○ |
| CE1 | 66 | 35 | $10^{13}$ | 0.3 | AC | X | ◎ | X | ○ |
| CE2 | 75 | 60 | $10^{12}$ | 0.3 | AC | X | ○ | X | ◎ |
| CE3 | 66 | 35 | $10^{14}$ | 0.4 | AC | Δ | ○ | Δ | ○ |
| CE4 | 70 | 35 | $10^{11}$ | 0.2 | AC | X | ◎ | Δ | ○ |
| CE5 | 70 | 35 | $10^{9}$ | 0.3 | AC | X | ◎ | X | ○ |
| CE6 | 60 | 35 | $10^{14}$ | 0.3 | DC | ◎ | ○ | ○ | Δ |
| CE7 | 70 | 35 | $10^{15}$ | 0.3 | DC | ◎ | X | ○ | ○ |
| CE8 | 70 | 65 | $10^{14}$ | 0.3 | DC | ◎ | ○ | Δ | ◎ |
| CE9 | 55 | 35 | $10^{12}$ | 0.3 | DC | ◎ | ◎ | ○ | X |
| CE10 | 70 | 35 | $10^{10}$ | 0.5 | DC | ◎ | ○ | X | ○ |
| CE11 | 70 | 35 | $10^{8}$ | 0.3 | DC | Δ | ◎ | ○ | Δ |
| CE12 | 80 | 35 | $10^{14}$ | 0.3 | AC | ○ | ○ | ○ | Δ |
| CE13 | 70 | 35 | $10^{15}$ | 0.3 | AC | ○ | X | ○ | ○ |
| CE14 | 70 | 65 | $10^{14}$ | 0.3 | AC | ◎ | ○ | Δ | ◎ |
| CE15 | 55 | 35 | $10^{12}$ | 0.3 | AC | ○ | ◎ | ○ | X |
| CE16 | 70 | 35 | $10^{14}$ | 0.5 | AC | ○ | Δ | X | ○ |
| CE17 | 70 | 35 | $10^{8}$ | 0.3 | AC | X | ◎ | ○ | Δ |

From Table 2, it is understood that adhesion of carriers to a photoconductor is affected by saturation magnetization of the carriers. Adhesion of carriers to a photoconductor occurred in Comparative Examples CE6, CE9, CE12 and CE15 in which the saturation magnetization of carriers was smaller than 66. Adhesion of carriers to a photoconductor also occurred in Comparative Examples CE11 and CE17, in which the static resistance of carriers is low at $10^8$ Ωcm. Thus, occurrence of adhesion of carriers to a photoconductor depends on saturation magnetization and in some cases on static resistance of carriers.

A spotted halftone image easily occurs when an AC bias is applied as the development bias, and occurred in Examples E1–E5 in which a superimposed bias was applied. In Comparative Examples CE12 and CE15 in which the saturation magnetization of carriers was relatively small, even when a superimposed bias was used, a spotted halftone image did not occur. However, in Comparative Examples CE12 and CE15, as described above, adhesion of carriers to a photoconductor occurred, which is undesirable. Also, occurrence of a spotted halftone image affected by static resistance of magnetic carriers, and in Comparative Examples CE11 and CE17 in which the static resistance of carriers is low as $10^8$ Ωcm, a spotted halftone image occurred even though only a DC bias was applied as the development bias.

Figure 13:
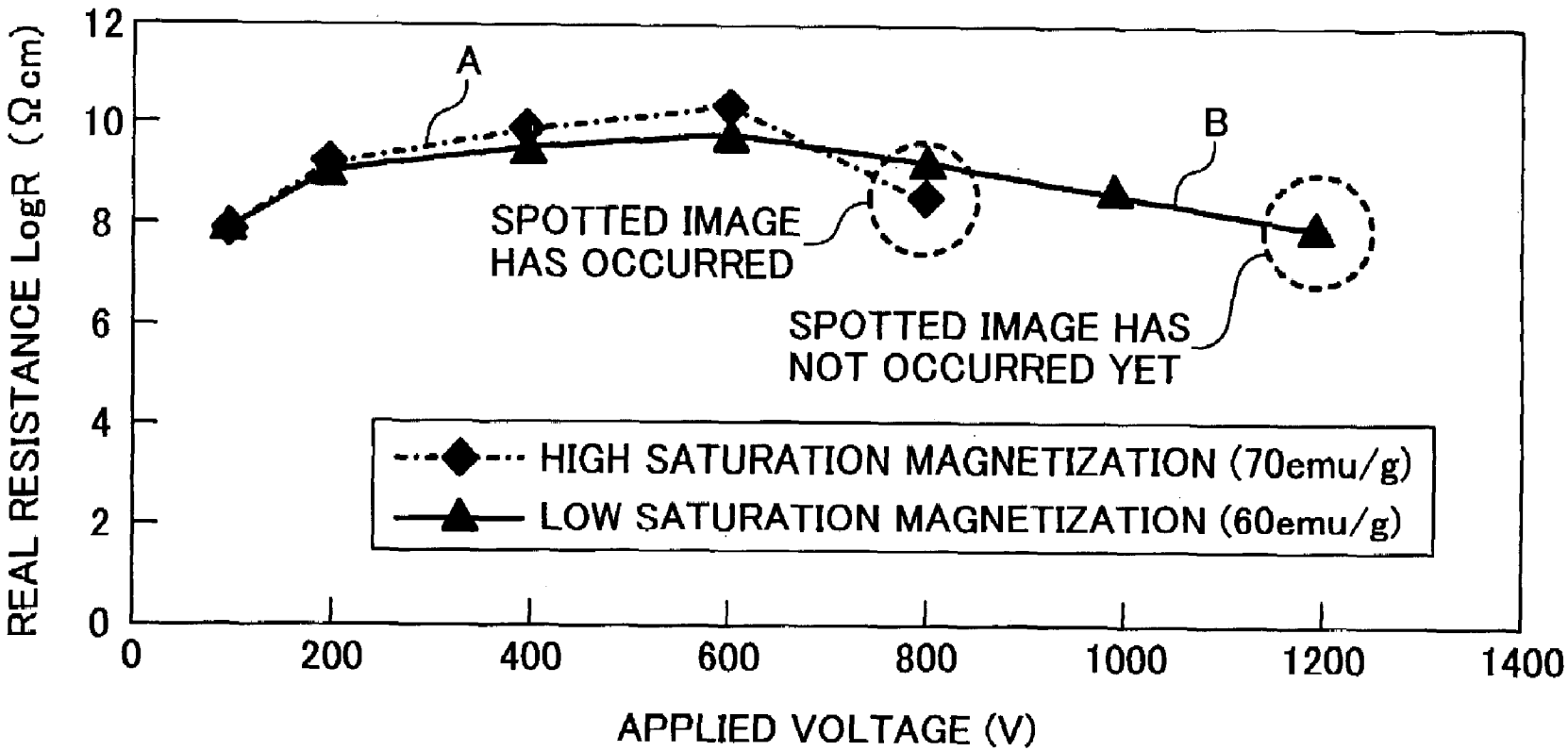
FIG. 13 is a diagram of a graph indicating a result of investigating a difference in a relation of saturation magnetization of magnetic carriers and occurrence of a spotted halftone image between a case A in which the saturation magnetization of magnetic carriers has been set relatively high at 70 emu/g and a case B in which the saturation magnetization of magnetic carriers has been set relatively low at 60 emu/g.

FIG. 13 is a diagram of a graph indicating a result of investigating a difference in a relation of saturation magnetization of magnetic carriers and occurrence of a spotted halftone image between a case A in which the saturation magnetization of magnetic carriers was set relatively high at 70 emu/g and a case B in which the saturation magnetization of magnetic carriers was set relatively low at 60 emu/g. In both of the cases A and B, a superimposed bias was applied, and real resistance of the magnetic carriers was measured at intervals of 200V.

Figure 14:
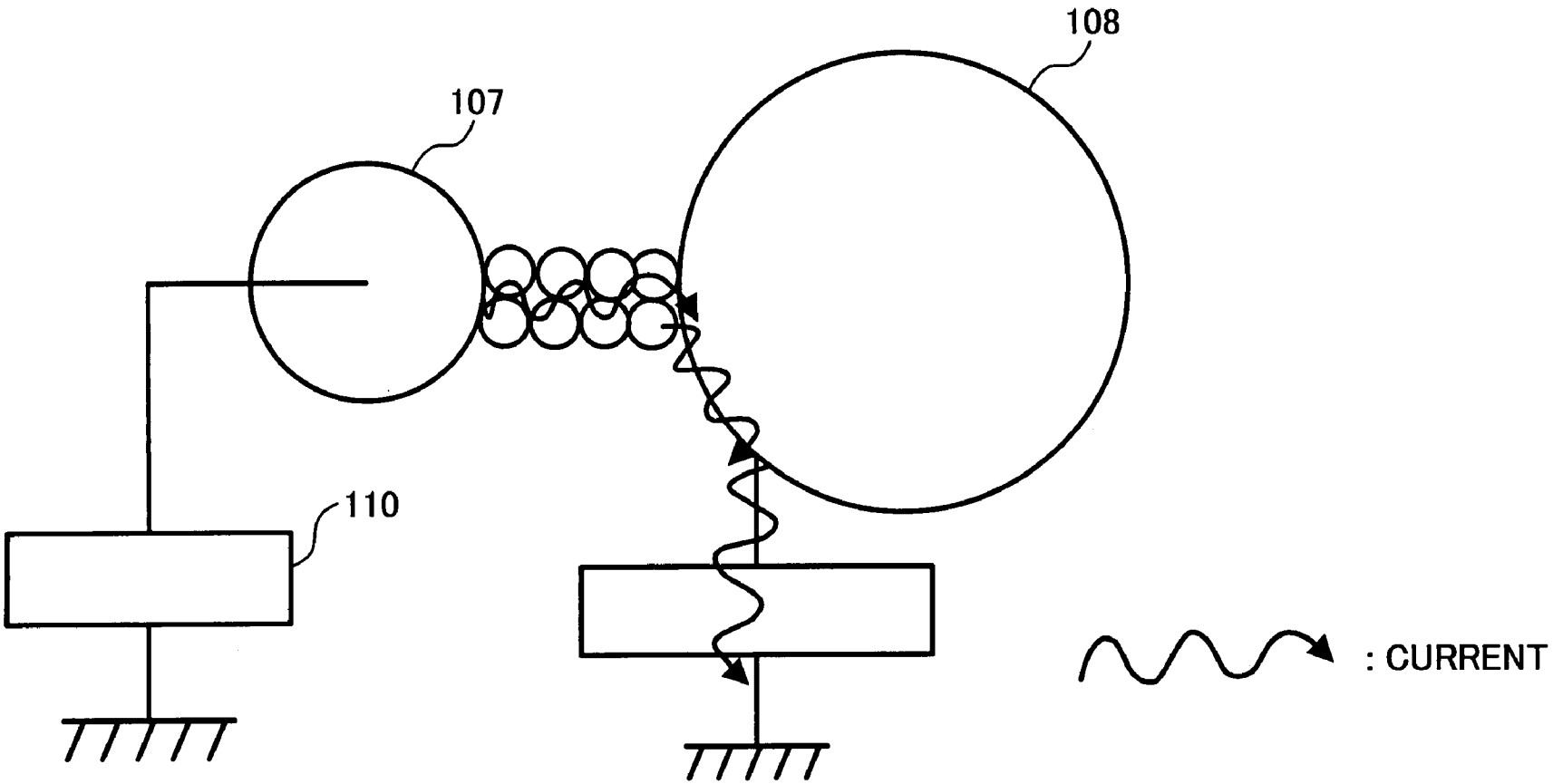
FIG. 14 is a diagram illustrating a schematic construction of a real resistance measurement instrument.

FIG. 14 illustrates a schematic construction of a real resistance measurement instrument used in measurement, and as illustrated FIG. 14, a bias is applied to a development sleeve 107 from a power source 110 and thereby a magnetic brush is formed. A jig photoconductor 108 made of aluminum is used as a photoconductor opposing the development sleeve 107, and the distance between the development sleeve 107 and the photoconductor 108 is 0.35 mm. The development sleeve 107 is rotated, and a DC bias is applied to the development sleeve 107. Then, an electric current flowed into the jig photoconductor 108 is measured by a multimeter to be converted to a resistance value. Table 3 indicates a result of measurement of real resistance of magnetic carriers with respect to the cases A and B.

TABLE 3

| | Applying Voltage (V) | | | | | | | |
|---|---|---|---|---|---|---|---|---|
| | 100 | 200 | 400 | 600 | 800 | 1000 | 1200 | 1400 |
| Case A | 7.9 | 9.1 | 9.9 | 10.3 | 8.6 | BD | | |
| Case B | 8.1 | 9.1 | 9.6 | 9.9 | 9.3 | 8.7 | 8.0 | BD |

From the results indicated in FIG. 13 and Table 3, real resistance of magnetic carriers changes depending upon saturation magnetization of the magnetic carriers. A state that real resistance of magnetic carriers cannot be measured, i.e., a breakdown state, occurred in the case A wherein the saturation magnetization of magnetic carriers is higher than that of the case B at a lower applying voltage than in the case B. A breakdown state is a state wherein real resistance of carriers is so low that a large current that cannot be measured flows. In Table 3, BD indicates that a breakdown state has occurred. Also, it has been confirmed by visual observation that by increasing saturation magnetization of carriers, each magnetic brush bristle becomes thick and short. From such observation, it has been understood that when saturation magnetization of carriers is relatively high, because the carriers gather together thickly to form a magnetic brush, real resistance of the carriers in a development area decreases, so that leaking occurs. As a result, a spotted halftone image occurs.

Because occurrence of a spotted halftone image is also related to static resistance of a magnetic carrier being excessively low, it may be conceivable to increase static resistance of the magnetic carrier with a coating film of the magnetic carrier to prevent occurrence of a spotted halftone image. Further, it is possible to prevent leaking in AC biasing. However, when static resistance of carriers is too high, it is feared that an inferior image such as a hollow image gets worse. Here, static resistance of a carrier is a resistance value measured in a state that the carrier is packed in a cell. The resistance value is a value measured by a high-resistance measure instrument after a magnetic carrier was placed between resistance measurement parallel electrodes having a gap of 2 mm, 30 sec after applying a DC bias, and then converted to volume resistivity. In Comparative Examples CE7 and CE13, the static resistance of carriers when 1000V was applied was $10^{15}$ Ωcm, and evaluation results with respect to a hollow image indicate extremely unsatisfactory results, respectively.

On the other hand, in Comparative Examples CE3, CE6, etc. wherein the static resistance of carriers when 1000V was applied was $10^{14}$ Ωcm, evaluation results with respect to a hollow image indicate satisfactory results, respectively. From this, it can be said that for suppressing a hollow image within an allowable range, static resistance of carriers should not be too high. Here, static resistance of a carrier is resistance when the carrier is in a packed state in a cell and real resistance of a carrier is resistance when the carrier is in a magnetic-brush state.

Thus, when static resistance of a magnetic carrier is too low, a spotted halftone image may be caused, and adhesion of the carrier to a photoconductor due to charge injection may occur. On the other hand, when static resistance of the carrier is too high, an inferior image such as a hollow image, etc. may get worse. For avoiding such deterioration of image quality, therefore, static resistance of a carrier is preferably made low as much as possible. In addition, when an AC bias is applied, because the applying voltage is relatively large, a lower limit of a setting range of static resistance values must be increased as compared with a case of applying only a DC bias. Accordingly, by applying only a DC bias as the development bias, static resistance of carriers can be set relatively low as compared with a case of applying an AC bias, so that it becomes possible to set the static resistance of the carriers such that an inferior image such as a hollow image, etc. will not exceed an allowable range.

Next, description is made with respect to improving graininess of an image, which is another aspect of a high quality image. One of the conditions affecting graininess of an image is the development gap PG, which is a gap between the photoconductor 8 and the development sleeve 7 in the development area. When the development gap PG is too large, a development electric field does not reach the photoconductor 8 from the development sleeve 7, so that a so-called returning electric field in which the development electric field returns to a surface of the development sleeve 7 is caused. In this case, toner does not adhere to an image area on the photoconductor 8 uniformly, and in particular, graininess of a halftone image is deteriorated. Therefore, for improving graininess of an image, the development gap PG is set relatively small, i.e., 0.4 mm or smaller. It is known that making the development gap PG smaller improves a hollow image and a solid/line toner adhesion ratio (a ratio between quantities of toner adhesion in a solid image area and a line image area), etc. However, if the development gap PG is made too small, slight variation in the development gap PG may cause the development sleeve 7 and the photoconductor 8 to contact each other while sandwiching a developer, or toner sandwiched between them may be caused to fixedly adhere to the development sleeve 7. In Examples E1 through E5 of the present invention, the lower limit of the development gap PG was set at 0.2 mm, which is a generally set lower limit value.

In Comparative Examples CE10 and CE16, the development gap PG was set relatively large at 0.5 mm, and evaluation results with respect to graininess of an image were extremely unsatisfactory. Generally, when a spotted halftone image occurs, graininess of an image is also deteriorated. In Examples E1 through E5 of the present invention, the development gap PG was 0.2 mm or greater but not exceeding 0.4 mm, and thereby a development electric field uniformly reached an image area on the photoconductor 8, so that graininess of an image was satisfactory. Graininess of an image is also related to particle diameters of magnetic carriers and toner, and when such toner having a relatively small particle diameter is used as in the embodiment of the present invention, the graininess of an image is further improved.

Further, for magnetic carriers of a developer, a carrier having a coating film including at least a bonding resin and particles and in which the relation of ($1<D/h<10$) between a diameter D of the particles and a thickness h of a film of the bonding resin is satisfied was used. When magnetic carriers having relatively high saturation magnetization are used in a developer, quantity of the developer held at the upstream side of the doctor 9 (the upstream side in the rotation direction of the development sleeve 7) is increased, so that extremely high stress is given to the developer. Therefore, scraping of a carrier coating film, contamination of surfaces of the carriers due to adhesion of melted toner, etc., occur, so that a life of the developer is decreased. However, in the present invention, by using the above-described magnetic carrier satisfying the above-described relation between a diameter D of particles of the carrier and a thickness h of a bonding resin film of the carrier, a remarkable effect has been obtained in improving a magnetic carrier life.

In the above-described magnetic carrier, the particles are relatively convex as compared with the bonding resin film. Therefore, in stirring a developer including the carriers and toner so that the developer is charged by friction, contacting of the carriers with each other or with toner, which is accompanied by a strong shock against the bonding resin film due to friction between the carriers or with the toner, is mitigated. Thereby, scraping of the bonding resin film where charging occurs, and contamination of the carriers due to toner adhesion can be prevented, so that the life of the carriers can be greatly enhanced. When the ratio of D/h is 1 or smaller, the particles are buried in the bonding resin film, so that the effect of adding the particles is greatly decreased, which is not desirable. When the ratio of D/h is 10 or greater, the contacting area between the particle and the bonding resin film is relatively small, so that a sufficient holding force cannot be obtained and the particle is easily detached from the bonding resin film, which is also undesirable. When a doctor having rigidity and magnetization is used for improving the charge rising characteristic of toner, the above-described effect on improving a magnetic carrier life is greater because when a magnetic doctor is used, the quantity of a developer held at the doctor is increased and thereby a stress given to the developer is excessively large. Here, the magnetic doctor may be constructed not only by a metal material such as steel and stainless, but also by a resin material in which a magnetic particle such as ferrite or magnetite is compounded, for example. Further, instead of constructing the doctor with a magnetic material, the doctor may be constructed with a non-magnetic member and a magnetic member such as, for example, a metal plate attached to the non-magnetic member directly or indirectly, and thereby substantially the same effect on improving a carrier life, as described above, can be obtained.

Figure 15:
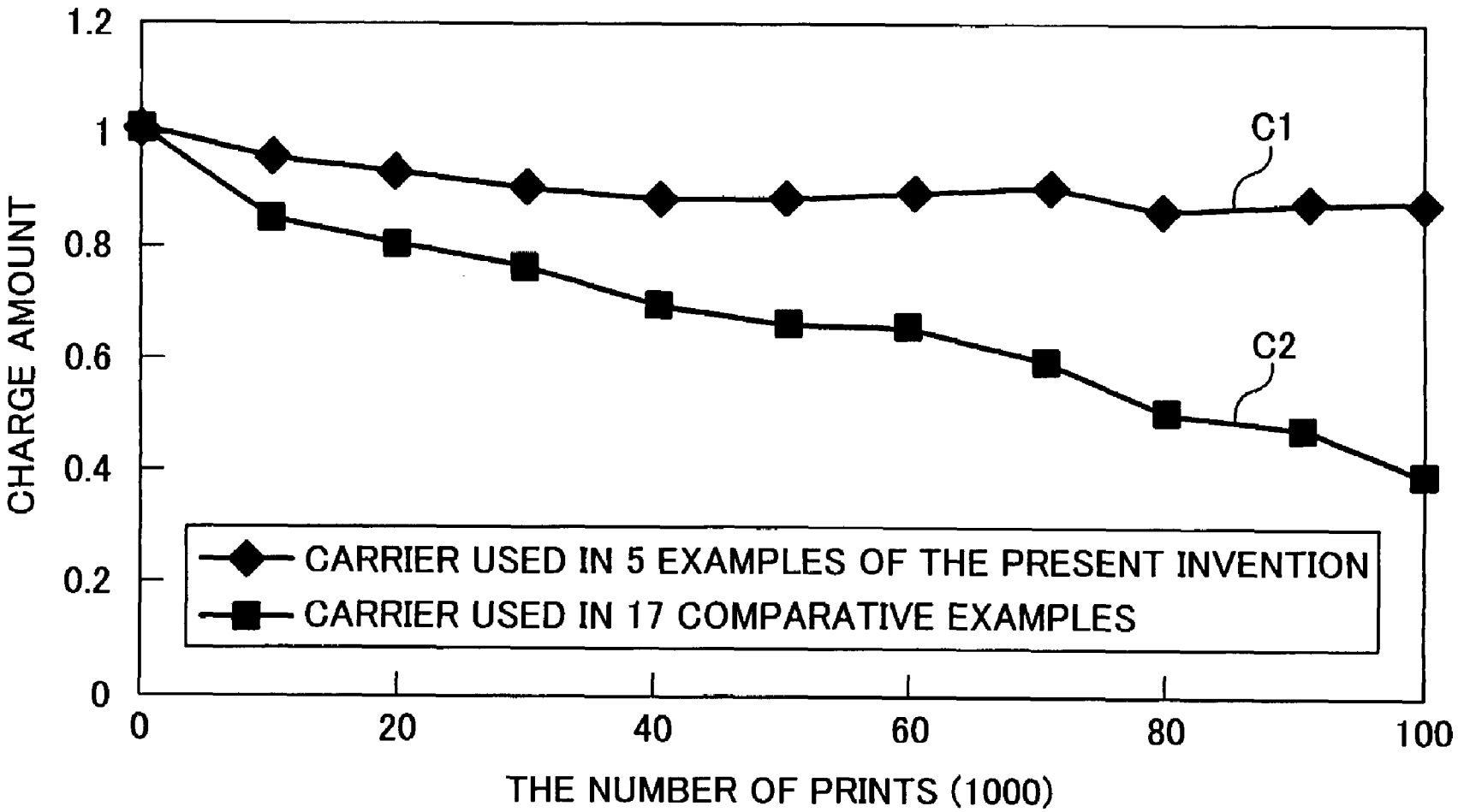
FIG. 15 is a diagram of a graph indicating changes in charge amount over the number of images (prints) produced by a printer, with respect to an exemplary carrier of the present invention and a carrier of a comparative example.

FIG. 15 is a diagram of a graph indicating changes in charge amount over the number of images (prints) produced by the printer, with respect to a carrier C1 of Examples E1–E5 satisfying the above-described relation of (1<D/h<10) and a carrier C2 of Comparative Examples CE1–CE17. In the graph, decreasing ratios relative to a charge amount of 1 when starting printing images are indicated. The charge amount is caused to decrease by excessive adhesion of toner to carriers, etc. while the prints are made. When the charge amount is 0.8 or smaller, i.e., when the decreasing ratio exceeds 20%, an inferior image starts to occur. In FIG. 15, the charge amount of the carrier C1 is greater than 0.8 even when the number of prints exceeds 100,000. In contrast, the charge amount of the carrier C2 is 0.8 or smaller before the number of prints reaches 100,000. From this, it can be said that the carrier of the present invention that has a coating film including at least a bonding resin and particles and that satisfies the relation of (1<D/h<10) wherein D is a diameter of the particles and h is a thickness of a film of the bonding resin, can suppress a decrease in charge amount due to excessive adhesion of toner to the carriers. The upper limit of the value of D/h is preferably 5 from the aspect of preventing detachment of the particles from the film of the bonding resin.

In Examples E1 through E5 of the present invention, the average particle diameter by weight of magnetic carriers was 20 μm or greater but not exceeding 60 μm, the saturation magnetization of the carriers was 66 emu/g or greater but not exceeding 100 emu/g, and the static resistance of the carriers when 100V is applied was $10^9$ Ωcm or greater but not exceeding $10^{14}$ Ωcm. Further, only a DC bias was applied as the development bias. Thereby, while using carriers relatively small in particle diameter for enhancing image quality, adhesion of the carriers to a photoconductor is suppressed and at the same time suppressing a spotted halftone image and a hollow image within an allowable range can be achieved. In the above-described embodiment, the magnetic flux density of the primary pole PP1 was 120 mT, and the magnetic flux density of the pole PP2 at the downstream side of the primary pole PP1 was 110 mT. However, those magnetic flux densities are not limited to those values, and the advantages of the present invention can be obtained if the magnetic flux densities of respective poles are greater than the above-described values.

In Examples E1 through E5 of the present invention, the development gap PG was made 0.2 mm or greater but not exceeding 0.4 mm, and thereby graininess of an image is satisfactory.

Further, for magnetic carriers of Examples E1 through E5 of the present invention, a carrier having a coating film including at least a bonding resin and particles and satisfying the relation of (1<D/h<10) wherein D is a diameter of the particles and h is a thickness of a film of the bonding resin is used. Thereby, a decrease in charge amount with adhesion of melted toner to a surface of the carrier is reduced, so that increasing of the life of a developer including the carrier can be achieved. Furthermore, the development gap PG is 0.4 mm or smaller, which is relatively small, so that a relatively high stress is given to a developer passing the development gap PG. However, by using the above-described magnetic carrier, the life of the developer can be more effectively improved.

Numerous additional modifications and variations of the present invention are possible in light of the above teachings. It is therefore to be understood that within the scope of the appended claims, the present invention can be otherwise than as specifically described herein.

What is claimed is:

1. An image forming apparatus, comprising:

an image bearing member configured to bear an electrostatic latent image on a surface thereof;

a developer bearing member including a non-magnetic development sleeve, the development sleeve including a fixed magnetic field generation device inside thereof and configured to rotate while bearing on a surface thereof a two-component developer including a magnetic carrier and toner; and a development electric field generation device configured to generate a development electric field between the image bearing member and the developer bearing member, wherein the electrostatic latent image on the image bearing member is configured to be visualized into a toner image with the toner of the two-component developer borne on the developer bearing member by a function of the development electric field generated by the development electric field generation device, and wherein an average particle diameter by weight of the magnetic carrier is 20 μm or greater but not exceeding 60 μm, a saturation magnetization of the magnetic carrier in a magnetic field of 1 kOe is 66 emu/g or greater but not exceeding 100 emu/g, a static resistance of the magnetic carrier when a bias of 1000V is applied to the magnetic carrier is $10^9$ Ωcm or greater but not exceeding $10^{14}$ Ωcm, and only a DC bias is applied to generate the development electric field by the development electric field generation device, and wherein the magnetic carrier has a coating film including at least a bonding resin and particles, and a diameter D of the particles and a thickness h of a film of the bonding resin satisfies a relation of (1<D/h<10).

2. The image forming apparatus according to claim 1, wherein a gap between the image bearing member and the developer bearing member is 0.2 mm or greater but not exceeding 0.4 mm.

* * * * *